US010046224B2

(12) United States Patent
Thostrup

(10) Patent No.: US 10,046,224 B2
(45) Date of Patent: Aug. 14, 2018

(54) BOXING DEVICE FOR PERFORMING A HARMLESS BOXING MATCH, METHOD AND USES THEREOF

(71) Applicant: JABii Group ApS, Københvn K (DK)

(72) Inventor: Christian Thostrup, København K (DK)

(73) Assignee: JABii Group ApS, København K (DK)

( * ) Notice: Subject to any disclaimer, the term of this patent is extended or adjusted under 35 U.S.C. 154(b) by 0 days.

(21) Appl. No.: 15/552,178

(22) PCT Filed: Feb. 25, 2015

(86) PCT No.: PCT/IB2015/051392

§ 371 (c)(1),
(2) Date: Aug. 18, 2017

(87) PCT Pub. No.: WO2016/135530

PCT Pub. Date: Sep. 1, 2016

(65) Prior Publication Data

US 2018/0036620 A1 Feb. 8, 2018

(51) Int. Cl.
*A63B 69/26* (2006.01)
*A63B 71/00* (2006.01)
(Continued)

(52) U.S. Cl.
CPC ..... *A63B 69/26* (2013.01); *A63B 71/145* (2013.01); *A63B 71/0054* (2013.01);
(Continued)

(58) Field of Classification Search
CPC ..... A63B 21/0004; A63B 21/00058; A63B 21/00069; A63B 21/00072;
(Continued)

(56) References Cited

U.S. PATENT DOCUMENTS 729,473 A 5/1903 Wilson
2,147,157 A * 2/1939 Goertz ..... A63B 67/20 273/330

(Continued)

OTHER PUBLICATIONS

International Search Report and Written Opinion, Appl. No. PCT/IB2015/051392, dated Oct. 9, 2015.

(Continued)

*Primary Examiner* — Joshua Lee
*Assistant Examiner* — Gary D Urbiel Goldner
(74) *Attorney, Agent, or Firm* — Winston & Strawn LLP

(57) ABSTRACT

A boxing device (1,400) serves for performing a harmless boxing match. The boxing device (1,400) has a base (2,5,53,87), a buffer (3,6,54) configured to hit a target (A,B,75) without injuring the target (A,B,75), and an extensible joint (4,7,54) that connects the base (2,5,53,7) and the buffer (3,6,54) to move the buffer between a retracted position and one or more extended positions. The extensible joint (4,79,82) is an element assembly of at least two extension elements (8,9,55,56,80*a*,80*b*), the extensible joint is configured to move the buffer (3,6,54) into the one or more extended positions by virtue of the propulsive force transferred to the extensible joint (4,79,82) by a punch done by a hand of a boxer (A,B) holding the boxing device (1,400), and auto-retract after the punch has been performed. The harmless boxing match is an enjoyable and beguiling exercise, which furthermore imparts good and healthy motions to the participants.

17 Claims, 18 Drawing Sheets

(51) Int. Cl.
*A63B 71/14* (2006.01)
*A63F 9/24* (2006.01)

(52) U.S. Cl.
CPC ..... *A63B 2208/12* (2013.01); *A63B 2244/102* (2013.01); *A63F 2009/241* (2013.01); *A63F 2009/2408* (2013.01)

(58) Field of Classification Search
CPC ..... A63B 21/00076; A63B 21/00178; A63B 21/00181; A63B 21/00185; A63B 21/002; A63B 21/0023; A63B 21/02; A63B 21/021; A63B 21/022; A63B 21/023; A63B 21/025; A63B 21/027; A63B 21/04; A63B 21/0407; A63B 21/0414; A63B 21/0421; A63B 21/0428; A63B 21/0435; A63B 21/0442; A63B 21/045; A63B 21/0455; A63B 21/05; A63B 21/055; A63B 21/0552; A63B 21/0555; A63B 21/0557; A63B 21/065; A63B 21/068; A63B 21/08; A63B 21/15; A63B 21/151; A63B 21/159; A63B 21/28; A63B 21/285; A63B 21/4001; A63B 21/4017; A63B 21/4019; A63B 21/4021; A63B 21/4023; A63B 21/4027; A63B 21/4033; A63B 21/4035; A63B 21/4039; A63B 21/4043; A63B 21/4045; A63B 21/4047; A63B 21/4049; A63B 23/035; A63B 23/03508; A63B 23/03516; A63B 23/03533; A63B 23/03541; A63B 23/12; A63B 23/1209; A63B 23/1245; A63B 23/1281; A63B 23/14; A63B 23/16; A63B 24/0059; A63B 24/0062; A63B 24/0075; A63B 24/0084; A63B 24/0087; A63B 2024/0065; A63B 2024/0068; A63B 2024/0078; A63B 2024/0081; A63B 2024/0096; A63B 69/20; A63B 69/201; A63B 69/203; A63B 69/205; A63B 69/206; A63B 69/208; A63B 69/24; A63B 69/26; A63B 69/32; A63B 69/325; A63B 69/34; A63B 69/345; A63B 71/0054; A63B 71/06; A63B 71/0619; A63B 71/0622; A63B 71/0669; A63B 71/14; A63B 71/141; A63B 71/145; A63B 2071/0063; A63B 2071/0072; A63B 2071/0081; A63B 2071/009; A63B 2071/0647; A63B 2071/065; A63B 2071/0694; A63B 2208/12; A63B 2225/09; A63B 2225/093; A63B 2225/096; A63B 2244/10; A63B 2244/102; A63B 2244/106
USPC ..... 482/83–90
See application file for complete search history.

(56) References Cited

U.S. PATENT DOCUMENTS

| | | | | | |
|---|---|---|---|---|---|
| 2,998,974 | A * | 9/1961 | Stafford | A63B 69/02 | 273/440.1 |
| 3,229,979 | A | 1/1966 | Smoak, Jr. | | |
| 3,643,948 | A * | 2/1972 | Coates | A63B 67/10 | 273/330 |
| 3,687,453 | A | 8/1972 | Fraga | | |
| 3,794,323 | A * | 2/1974 | Johnson | A63B 67/22 | 124/5 |
| 3,907,287 | A * | 9/1975 | Fox | A63B 69/0088 | 473/424 |
| 4,759,550 | A * | 7/1988 | Cuffia | A63B 67/20 | 273/330 |
| 4,836,555 | A * | 6/1989 | Wexler | A63B 67/20 | 273/330 |
| 5,181,726 | A * | 1/1993 | Piaget | A63B 21/0603 | 273/330 |
| 5,366,427 | A * | 11/1994 | Price, II | A63B 21/05 | 273/123 R |
| 5,571,037 | A * | 11/1996 | Sellers | A63H 5/00 | 446/188 |
| 5,976,041 | A * | 11/1999 | Banker, Sr. | A63B 43/007 | 473/424 |
| 6,368,241 | B1 * | 4/2002 | Abel | A63B 69/0086 | 473/508 |
| 6,371,824 | B1 * | 4/2002 | Brown | A63H 1/30 | 446/250 |
| 6,406,408 | B1 * | 6/2002 | Price, II | A63B 21/05 | 434/252 |
| 6,918,842 | B2 * | 7/2005 | Miller | A63B 69/0002 | 473/422 |
| 7,364,518 | B2 * | 4/2008 | Abel | A63B 43/007 | 473/508 |
| 7,833,115 | B2 * | 11/2010 | Abel | A63B 43/007 | 473/508 |
| 2005/0014580 | A1 * | 1/2005 | Silman | A63B 69/0002 | 473/424 |
| 2011/0071007 | A1 | 3/2011 | Signorino | | |
| 2011/0088131 | A1 | 4/2011 | McVan | | |
| 2011/0098094 | A1 * | 4/2011 | Forsell | A63B 69/004 | 463/8 |
| 2012/0157263 | A1 * | 6/2012 | Sivak | G06F 3/014 | 482/4 |
| 2012/0279311 | A1 * | 11/2012 | Helmer | A63B 24/0021 | 73/768 |

OTHER PUBLICATIONS

International Preliminary Report on Patentability, Appl. No. PCT/IB2015/051392, dated Aug. 10, 2016.
Anonymous, "77: A punch in the face." XP055217069. Retrieved from the Internet: https://somethingaweek.wordpress.com/2011/09/10/77-a-punch-in-the-face/ (retrieved on Sep. 29, 2015).
The Dollar Store Toy Box: "Boxing Glove Gun," youtube, Dec. 22, 2011, 1 page, XP054976695. Retrieved from the Internet: https://www.youtube.com/watch?v=M4iJEf6RZIs (retrieved on Jul. 28, 2016).

* cited by examiner

BOXING DEVICE FOR PERFORMING A HARMLESS BOXING MATCH, METHOD AND USES THEREOF

This application is a 371 filing of International Patent Application PCT/M2015/051392 filed Feb. 25, 2015.

BACKGROUND

The invention relates to a boxing device for performing a harmless boxing match, the boxing device comprising a base, a buffer configured to hit a target without injuring said target, and an extensible joint that connects the base and the buffer to move said buffer between a retracted position and one or more extended positions.

The invention also relates to a method for performing a harmless boxing match between two boxers, and uses of the boxing device.

The conventional boxing sport is of relatively dangerous character, which implies that this sport is unsuitable for ordinary people to perform, especially children. Conventional boxing sport between two boxers must be performed under supervision, such as of a judge or coach.

In a virtual boxing match, such as e.g. Wii Sports Boxing from Nintendo, the boxers jab, punch or hook by moving a hand holding the Wii Remote or nunchuk forward making all efforts to hit each other virtually so that maximum fictive harm is caused, and this way score high points. Virtual boxing matches require a display screen to monitor the match as well as very expensive software and equipment. Moreover, the two boxers need to look at the screen through the boxing situation.

An inexpensive boxing toy is known from U.S. Pat. No. 729,473. This boxing toy has a striker made of a plurality of connected finger-loops, and an elastic cord secured thereto to carry a return ball. The boxer hits the return ball with his hand but due to the loose and slack elastic cord the return ball falls to the ground after returning and is not usable for a real boxing match or in a imitate boxing match wherein the next actions need to be taken very fast to avoid being hit when the other part make a counter attack. Moreover the elastic cord makes it impossible to control the direction of a punch and the return ball cannot be made ready for a next hit fast enough to be used in a real boxing match. This known toy is intended for, and only suitable for, use by one person alone for amusement.

Another known boxing device is the Boxing Glove Gun from the Dollar Store toy Box which can be seen in action on the U-tube video http://www.youtube.com/watch?v=M4iJEf6RZ1s. This known toy has a joint that is extensible by pulling at a trigger of a handle by the fingers to retract a thin hollow front plastic boxing glove connected to an incorporated elongated coil spring. The plastic boxing glove returns when the tension of the trigger is released, thus when the trigger is allowed to move forward. So activation of this device requires use of the fingers to move the trigger, and this known device is not usable to perform a real boxing match, because the action of retraction of the trigger needs to be synchronized with the punch, nor is any substantial physical exercise involved. This toy is too primitive for being used in a boxing match, nor is it intended.

SUMMARY OF THE INVENTION

It is a main aspect of the present invention to remedy the above disadvantages of prior art boxing devices.

Further, in a first aspect of the present invention is providing a boxing device and a method of the kind mentioned in the opening paragraph for performing a harmless boxing match.

In a second aspect of the present invention is provided a boxing device and a method of the kind mentioned in the opening paragraph which can be used even by children and unskilled boxers without getting injured.

In a third aspect of the present invention is provided a boxing device and a method of the kind mentioned in the opening paragraph which can be used for exercise purposes and entertainment.

In a fourth aspect of the invention is provided a boxing device and a method of the kind mentioned in the opening paragraph which can be used with stationary or moving participants.

In a fifth aspect of the invention is provided a boxing device and a method of the kind mentioned in the opening paragraph which can be used to perform a boxing match between two boxers at locations remote from each other.

In a sixth aspect of the invention is provided a boxing device and a method of the kind mentioned in the opening paragraph which has a high reliability and accuracy of hitting the target.

In a seventh aspect of the invention is provided a boxing device and a method of the kind mentioned in the opening paragraph which can be used in a harmless boxing game.

The novel and unique features according to the invention whereby these and other aspects are achieved consist in the fact that the extensible joint is an element assembly of at least two extension elements, the extensible joint is configured to move the buffer into the one or more extended positions by virtue of the propulsive force transferred to the extensible joint by a punch done by a hand of a boxer holding the boxing device, and to auto-retract after the punch has been performed.

The term "harmless boxing match" here means a fight between two boxers, who can perform a boxing match without doing each other any harm by using the boxing device according to the invention instead of common boxing gloves.

By providing an element assembly of at least two extension elements it becomes possible to have several extended positions depending on the force put into the punch. So a huge punch creates propulsion to the extensible joint and thus moves the buffer a good distance forward towards the target. A smaller punch moves the buffer less forward. The terms "propulsion" and "propulsive force" are used in the context of the present invention to indicate the act of moving something forward, in the present case the boxing device. The propulsion is the driving force that pushes and moves the extensible joint to be longer and thus moves the buffer forward towards the target. For the present invention propulsion is done without using the fingers to activate a spring or tension mechanism, as in the prior art discussed above. Thus the terms "propulsion" and "propulsive force" are in the context of the present invention to be understood as creating a force leading to movement of the boxing device and the buffer by using muscle power.

In a conventional boxing match the boxers fingers are completely confined inside the boxing gloves and cannot be used to move or otherwise actuate a trigger. The present invention aims to reflects the same circumstances as in a conventional boxing match, namely to hit the target by moving the arms and the hands, but not the fingers.

Moreover, the at least two extension elements confer a structural and dimensional stability to the extensible joint that allows the boxer, who uses the boxing device, to rely on the direction he/she hits towards, and be accurate and successful in the punch and hitting of the target. So even when most extended the extensible joint preserves its three dimensional configuration as a straightened elongate stiff object. Thus the boxer has a good chance of hitting the intended target, e.g. an opponent boxer, with the buffer when he/she makes e.g. a punch, jab or hook. When the boxers moves his/hers arm the element assembly extends and the buffer comes along due to the propulsion, so for most punches the arm movement exclusively creates the driving force of the boxing device, which allows the boxers to make moves and actions almost similar to those known from a real boxing match, but without injuring each other because the terminal extension element of the element assembly has lost some speed at the end of the punch so that the injuring and/or harming effect of the impact with the target is relieved and of no harm to the target.

The boxing sport does not only have negative and harmful consequences to the boxers. The boxing sport also have many good qualities, including being a very healthy exercise. The boxers are also challenged to physical power, concentration and capability to react very fast. The boxing device and method of the present invention eliminates the known disadvantages but allows a boxer to benefit from the above advantages. A boxing device according to the present invention makes boxing a beguiling experience for both boxers and onlookers, because the boxing match can be carried out without the boxers have suffered any harm or have been injured but can make movements that resembles those of a boxing match and/or make movements towards the target to perform a game, e.g. where hits are counted.

The extensible joint may conveniently be structured to provide an overall rigidity to the joint in any of the extended positions along the longitudinal axis of said extended joint to further improve dimensional stability, thus in the extended positions wherein the various lengths of the element assembly have been given and defined by the amount of propulsion given by the punching arm.

To support the dimensional stability of the extensible joint, in particular in extended positions, the extensible joint can advantageously be made of one or more rigid materials.

So the extensible joint has various lengths, including a length that is shortest in a starting position of the harmless boxing match, and depending on the propulsion and the force of the punch the extensible joint, thus the element assembly, is extensible to longer lengths to achieve other positions of the buffer of the boxing device, such as various extended positions.

In one or more embodiments the base and the element assembly may have a common longitudinal axis so that the base and the element assembly are aligned and easy to operate, as well as not being more voluminous than expedient to perform the boxing match. Further, the common axis allows the boxing device to operate and function in the same way at all times.

A very expedient element assembly may comprise at least one linearly, foldable and extensible, row of pivotally or telescopically connected extension elements. These structures confer a very versatile and easily operated boxing device that can be extended and retracted unobstructed and rapidly to allow the boxer to makes the next move.

In a preferred embodiment the boxing device may comprise three linearly, foldable and extensible, rows of pivotally extension elements, which rows are interconnected lengthwise along adjacent sides to define a triangular tubular outline about the longitudinal axis, which triangular outline delimits a central lengthwise opening, that can be used to accommodate one or more component of e.g. an auto-retraction means. This design of the element assembly is very stable and efficient. This three-row embodiment is also very easy to use and has a high degree of freedom with respect to angular orientation of the hand holding the boxing device. Thus if e.g. the wrist of the boxer is turned, such turning has no negative impact on the operation and function of the boxing device, which works consistently and reliable in all different angular positions. Preferably the triangular outline is an equilateral triangle.

The linearly, foldable and extensible, row of pivotally extension elements are preferable upper elements and lower elements, that are connected in a zig-zag arrangement, e.g. a zig-zag scissor arrangement, that will make the element assembly to assume different extended positions fast and reliable, and to auto-retract immediately at the end of the punch. The terms "upper element" and "lower element" are used in the context of the present invention to indicate that the elements merge so that one element is on top of the other, thus an upper element are placed on top of or is outside a lower element in the zig-zag structure.

The upper and lower elements of the element assembly can, according to the invention, be made relatively high, whereby is achieved that the long extended element assembly only bends down as little as possible when influenced by the gravity.

The upper and lower elements may each be formed with two side elements, such as e.g. side tubes, with side bearings and one central element, such as a central tube with a central bearing. The upper and lower elements can be assembled by means of side axles in the side bearings and a central axle in the central bearing. Thereby is facilitated a flexible extension and auto-retraction of the element assembly. Further is advantageously obtained that any tension, stress, force and bending moment conferred to the components of the boxing device during its use in a boxing match can be distributed to neighbouring components of the boxing device to prevent it from being damaged during boxing and thus prolong useful lifetime. So this embodiment can function effectively and securely.

A very flexible element assembly can be obtained if two adjacent linearly, foldable and extensible, rows of pivotally extension elements are assembled to each other at assembling points at opposite side axles by means of a bridge member.

The triangular outline delimits a central opening that defines a passageway inside which there is plenty of free space for accommodating means for facilitating auto-retraction. Moreover, this passageway is so large that any means for auto-retraction is at no risk of entangling the element assembly, irrespective of said element assembly being in retracted position or in any of the extended positions of different lengths. A further advantage is that this embodiment of a boxing device according to the invention, which consists of three single element assemblies that together form a triangle, achieves a very stiff boxing device with a large moment of resistance against being bent downwards by the gravity when extended.

Preferably, the triangular outline is an equilateral triangle so that the distance to all three vertices from the longitudinal axis are substantial the same at all times.

Two adjacent linearly, foldable and extensible, rows of pivotally extension elements of the set of three are expediently assembled to each other at assembling points at opposite side axles by means of a bridge member so that the three dimensional tubular structure is obtained. The bridge members serve to allow two adjacent connected rows to extend and retract as a common unit, and when the rows are in fully retracted state, the element assembly only takes up little space lengthwise because the bridge members in themselves do not take up extra space in the lengthwise direction and only take up little extra radial space.

The bridge member can have inclined sides that taper towards the longitudinal axis so that a bridge member does not protrude beyond the exterior outline of the cross-section of the joined three element assemblies that constitute the triangular extensible joint. Optionally the inclined sides form an angle of 60° with each other when the three element assemblies form an equilateral triangle.

To induce further flexibility to some embodiment of a boxing device at least the assembling points at opposite side axles closest to the buffer may be spanned by an elastic member. The elastic members are the sole or further retraction means.

The base may have at least one wall, which is provided with at least one side recess offset from a longitudinal axis of the base, wherein a side axle is meshing with the at least one side recess to allow the element assembly to flex to extend and retract in relation to the base. Thus the base and the element assembly is mutually connected via the recess, and an upper element or a lower element can move sidewise in the recess to compensate for the larger distance between opposite end of opposite element in the retracted position of the element assembly. If just one recess is provided sidewise movement may only be possible for one of an upper element or a lower element of such a set. The other element can be fixed to the wall of the base so that it cannot move laterally.

The base can also have two opposite walls, each of which has a side recess offset from a longitudinal axis of the base, wherein a side axle is meshing with the at least one side recess so that both the elements that are secured to the base can move sidewise. Alternatively two side recesses are provided in the same wall on opposite sides of the longitudinal axis.

A side recess can e.g. be perpendicular to the longitudinal axis of the base, in which embodiment the power that hits the target is absorbed to a great extent. However a side recess that has an inclination in relation to the longitudinal axis of the base is also possible.

According to the invention the axial orientation of the element assembly in relation to the base can be secured by forming at least one wall with at least one central recess extending along the longitudinal axis of the base, wherein a central axle of the element assembly is meshing with the central recess.

In an exemplary embodiment opposite walls of the base have two side recesses extending perpendicular to the common longitudinal axis and/or one central recess extending along said axis, a side axle that mesh with each of the side recesses, and a central axle that mesh with the central recess.

The orientation of the buffer in relation to the element assembly can be obtained in that the buffer is fastened to a foot of the base by means of a U-formed clamp.

Such an exemplary U-formed clamp can be of the kind having two legs each having a groove meshing on an outside of the element assembly by means of each their central axle, whereby the buffer can be fastened upon the foot of the U-formed clamp and the orientation of the buffer thus be established by means of the U-formed clamp.

A maximum extended length of the extensible joint is determined to correspond to a distance selected to allow a boxer to reach the target with the buffer when the extensible joint is in an extended position, but not reaching the target with the hands or the buffer in the auto-retracted starting position.

The selected distance can in one embodiment be obtained by a borderline or safety line behind which a boxer stands and is not allowed to cross during the harmless boxing match, and wherein the boxer can move his/her arm to move the buffer by propulsion of the extensible joint to touch but not harm the target. Two boxers can step back from the borderline or safety line if desired and expedient during the boxing match. Therefore the buffer should be able to pass the borderline of an opposite boxes when launching a punch. According to the invention is the maximum length of the element assembly in case of the boxing device being used in a borderline/safety line embodiment therefore determined by the fact that a boxer standing at the borderline can push the element assembly with the buffer far enough beyond the opposite borderline during the boxing match to hit but not harm the target.

The boxing device can be used with or without establishing borderlines.

As an example the above distance is selected to be so far, when launching a punch, that the buffer is situated 50 cm, preferably 25 cm and especially 15 cm from the outside of the borderline of the target, preferably an opposite boxer.

The elements of the element assembly can, according to the invention, have any suitable shape, such as rigid tubes, ribs, rods or bars. This list is not to be seen as exhaustive, but easy bendable elements are not within the scope of the present invention, such as element of rope or soft rubber, that yield by its very nature and when subjected to gravity.

A very suitable shape of an element of the element assembly can, according to the invention, be obtained by connecting the side tubes with the central tubes by means of upper and lower bars.

A strengthening plate can be attached to the elements of the extension elements in the corners between the tubes and the upper bars and lower bars. Alternatively, a number of sash bars can extend between the tubes and the bars.

The tubes, the bars and the strengthening plates or the sash bars can, according to the invention, be cast in one piece of a suitable material like e.g. hard plastic for obtaining inexpensive and uniform elements.

The moment of resistance against the element assembly being bent when extended can, according to the invention, be substantially enhanced by providing a strengthening bar on top and/or bottom of the element assembly. The strengthening bar advantageously connects those side axles and central axle, which are assembling each pair of upper extension elements and lower extension elements.

The moment of resistance against being bent can, according to the invention, be further enhanced in that the extensible joint has one or more elastics member each of which are connected to two side axles placed at each their side of at least one extension element of the element assembly.

At least one string of a spring arrangement extends at least partly along the longitudinal axis of the extensible joint between the base and the end of the extensible joint or the buffer to retract the extensible joint and the buffer after completion of a punch. Accordingly, the element assembly effectively auto-retracts to the starting position after having been driven into any extended position, which auto-retraction e.g. can take place by means of the spring power of the spring arrangement.

Expediently the at least one string of the spring arrangement extends through at least one central opening of the element assembly along its longitudinal axis. For the triangular embodiment the central opening is the central passageway, for other embodiment the central opening may be made adjacent the central axles.

The spring arrangement can conveniently be situated in or at the base whereto the element assembly auto-retracts before a new punch is done. For example the spring arrangement is fastened to the base and the free end of string is fastened to the buffer or an end part of the element assembly.

In the extended positions the boxing device can be relatively long, e.g. one meter. So in some embodiment the spring of the spring arrangement cannot be a lengthy spring, like e.g. a coil spring, but can according to the invention very well be a spiral spring with a number of windings.

An inner end of the windings of the spiral spring may be fixed to the base, and an outer end of the windings of the spiral spring be fixed to a spool. The spool can be rotatably mounted to the base and a number of windings of the at least one string be wrapped upon the spool that easily can accumulate more meters of windings.

The dimensions of the spring can be optimised for allowing various extended lengths and speeds of auto-retraction. An adjusting screw may be provided to apply tension to the spring arrangement so that a child can box against an adult. In such a boxing match the child, who has less physical force to transfer into propulsion, uses a boxing device with a less tensioned spring arrangement than the adult. So that when the child makes a punch the child is able to extend the element assembly sufficiently long with less force than the adult who uses a higher degree of tension for his/her boxing device to achieve same degree or propulsion. The adjusting screw or adjusting means can be adjusted quite as desired and according to the choice of the two boxers, or the single boxer fighting against himself by hitting a not live target.

The spring of the spring arrangement can e.g. have a width of 20-30 mm, such as 25 mm and have a thickness of between 1-3 mm, such as 2 mm. The outer end of the spring that is connected to the spool may taper, alternatively the inner end of the spring tapers.

In the triangular embodiment the string may be connected to an end part of each of the three assemblies of elements by means of joining strings, e.g. fastened to each theirs side axle, e.g. two joining string fastened to each their side axle.

Only one spring arrangement is enough for the triangular element assembly but for other embodiments more than one spring arrangement may be expedient.

In the triangular one spring arrangement the spring arrangement can be of the same kind as used in a single element assembly, and the string of the spring arrangement be selected to branch off into two or more connection strings which are fastened to side axles of each of the element assemblies of the triangular element assembly.

The at least one string of the spring arrangement can be carried through central openings at one or both sides of that portion of a central axle, which is situated in each opening. However a string pulled through the central openings of the element assembly affects the element assembly and thereby the boxing device with a bending moment owing to the presence of the middle of the central axles in said openings. According to the invention this moment can however be neutralized by using strings on both sides of the axles in respective central openings.

An alternative solution is to have only one string through the central openings at one side of the central axle only.

A handle mounted to or formed in the base is a convenient tool to operate the boxing device. It creates a firm grip and can be designed to guide the boxer to hold the boxing device correctly. For example the handle may be adapted to position the boxing device so that the at least one string will be placed above the central axle when using the handle to hold the boxing device.

Accordingly, the handle can be mounted on the outside of the base and adapted to place the single string above the central axle when using the handle to hold the base during operation whereby the bending moment acting upon the element assembly is turning upwards so that the downwards turning bending moment, with which the gravity is acting upon the element assembly, advantageously will be at least partly neutralized.

In an alternative embodiment the telescopically connected extension elements are tube sections that form an element assembly in form of a telescopic tube. Such a boxing device is very stiff and able to resist being bent in the extended condition of the element assembly. A spring arrangement in form of a tension spring can be fastened at one end to the base and the other end to the buffer or the foremost smallest diameter tube section. This structure of the boxing device enables a boxer to participate in a harmless boxing match and very precisely hit the target, e.g. an opposite boxer, with the buffer. Alternatively a coil spring arrangement with a string, as described previously, can be used.

The telescopically connected extension elements are thus tube sections of tubes having smaller and smaller diameters towards the buffer. These tube sections are movably connected and engaging each other in such a way that the extended telescopically interconnected tube sections form a stiff structure in the extended position of the buffer. To reduce friction at overlapping locations of adjacent tube sections at least one friction-reducing means can be interposed between the circumferential walls of two subsequent tube sections of the element assembly.

A preferred friction-reducing means can be an axially extending linear ball bearing.

The extension elements are rigid to the extent that the extended telescopic element assembly can carry its own weight and shape, and so that the longitudinal axis does not deflect substantially due to the weight of the extension elements and due to the element assembly being subjected to gravity when these extension elements are put in various advanced and extended positions when the boxers makes his/her punches. The extended extensible telescopic element assembly constitutes a self-supported more or less long arm protruding from the base.

Preferably the buffer is a rather soft body configured to yield to absorb at least some of the impact resulting from contact with the target so that the target is not harmed or injured.

To imitate a conventional boxing match the target is another boxer, however one boxer can also perform a boxing match in front of a stationary target, such as a dummy or a picture. Such a picture may have hitting points of various scores for the boxer to hit to optimise his performance. So the boxing device according to the present invention can also be used in amusing and/or exercise boxing games by adults, teenagers and children, e.g. by placing the picture to be hit in an appropriate height and boxing distance.

The boxing device can additionally have means to register and issue signals in response to contact with the target, to confirm the hit to the boxer. The issued signal can be a beep or other noise or a light signal that immediately confirms that the target has been hit. The sensor that register a hit may be provided at the buffer, or in the event the target is a dummy or a picture different touch sensors that elicit each theirs signal may be placed in said dummy or picture to score different points.

The signal can be transmitted to a receiver and be stored in a computer program configured to make statistics of hits and/or mishits, register scores etc., so that a boxer even can fight against himself/herself. Optionally the computer program includes gaming software, optionally any computer programmes such as gaming software, databases etc., are stored, operated and run by computer means. Preferably any computer means can be stored in a hollow handle, so that the weight of such computer means does not influence on the boxing performance, activity game, including registering and sensoring hit and mishits.

As mentioned above the present invention also relates to a method for performing a harmless boxing match between a boxer and a target, optionally between two boxers.

The method comprises the steps performed by the boxer of a) providing at least one boxing device, which at least one boxing device that comprises a base, a buffer intended to hit the target, such as another boxer, in a harmless way, and an extensible joint that connects the base and the buffer, which extensible joint has a length that is shortest in a retracted starting position of the harmless boxing match and extensible to longer lengths to achieve other positions of the buffer of the boxing device, b) taking hold at the base of the at least one boxing device by a hand of an arm, c) taking a position at a distance from the target selected to allow the boxer to reach the target with the buffer when the boxing device is in another position than the starting position but not reaching the target with the hands, d) moving and/or bending the arm holding the boxing device at least partly backwards while the extendible joint is in its starting position, e) pushing the boxing device against the target by moving the arm forward, preferably in the direction of the target and so fast, that the extensible joint extends from the starting position to a temporary other position, optionally an end position or a position in which the target has been hit by the buffer.

The method may additionally comprise step f) to move the arm at least partly backwards again for allowing the extended extensible joint to return to its retracted starting position.

To perform or imitate a boxing match wherein the boxer does not use his/her fingers, but perceives the boxing device as if a hand is confined inside a boxing glove, steps d)-f) are repeated.

The target can be another boxer placed within a distance from the boxer that allows the two boxers to hit each other in extended positions of the extensible joint and not with their hands or with the retracted buffer.

Alternatively the target is a dummy or a picture.

The method may be performed in an alternative mode wherein two boxers game against each other via an activated computer program that register data of hits and/or mishits of the boxing match.

The boxers may use a common computer program or a separate computer program on a PC or a mobile communication unit, such as a mobile phone or tablet, while being remote from each other, thus without visual sight of each other. Then the two boxers simply box against each other via the computer program, which computer programme is started at the beginning at the match and terminated at the end of the match. Synchronisation of the activation of the computer programme/programmes may be performed e.g. via the Internet or other communication line, such as a telephone line, via SMS, etc. The computer programme may even auto-execute at one boxer in response to the other boxer start his/her programme.

Preferred uses of the boxing device and the method includes but are not limited to use as a physical exercise tool, for boxing training, as a toy or in a game.

BRIEF DESCRIPTION OF THE DRAWINGS

The invention will be explained in greater details below and disclose further advantageous features and technical effects by describing exemplary embodiments with reference to the drawing, in which.

The figures show schematic and illustrative embodiments of extensible joints, boxing devices and components of spring arrangements. It should be emphasised that although a boxing device is shown in the figures without buffer and spring arrangement such may/are part of any of the embodiments. Buffer and spring arrangements are left out in the figures for illustrative purpose. Further features from different embodiments can be combined as convenient.

DETAILED DESCRIPTION OF THE INVENTION

Figure 1:
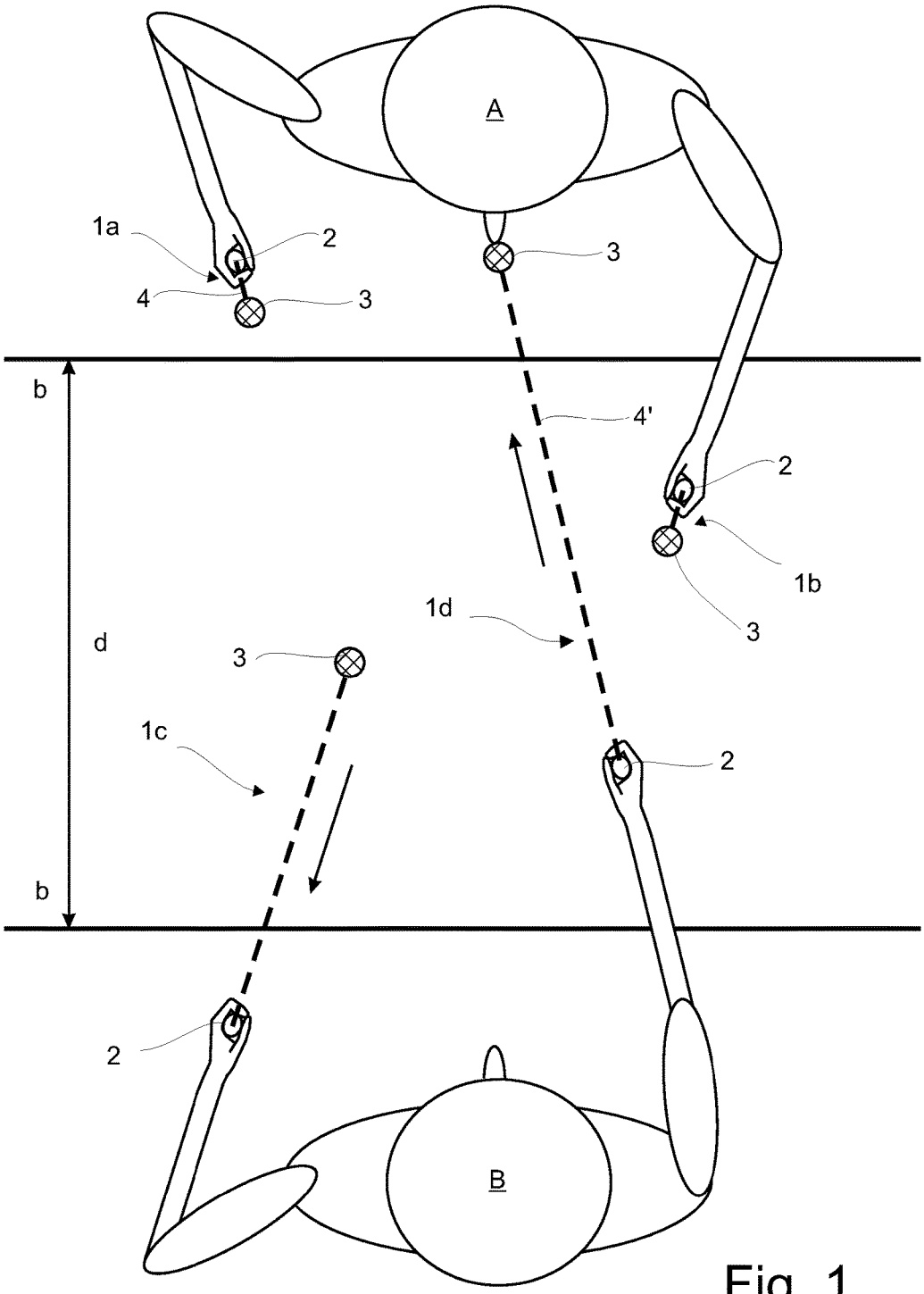
FIG. 1 is a schematic illustration, seen from above, of two boxers performing a harmless boxing match according to the invention.

FIG. 1 shows two boxers A and B acting in a boxing match in such way that they are not doing each other any harm.

In the present situation the two boxers A and B are positioned opposite each other behind each their borderlines b at such a distance d from each other that they cannot reach each other with their hands. The borderline is not mandatory but if they exist the boxers A,B participating in the harmless boxing match may preferably not cross the borderlines b during the match. Imaginary borderlines or safety lines can be observed and rules set out to that aspect. The essential issue is that during the match the boxers cannot reach each other with their hands but is able to touch or hit gently the opponent or other target with the buffer when the extensible joint is actuated by the propulsive force induced by the punch.

In the situation shown schematically in FIG. 1 the two boxers A,B both use a boxing device 1 according to the invention in trying to hit each other with a soft and harmless punch only. Boxer A uses a boxing device 1*a*,1*b* and boxer B uses a boxing device 1*c*,1*d*, The boxing device 1 comprises a base 2 to be hold by the hands of the boxers A and B during the boxing match, a buffer 3 selected so that a punch, which is launched by one of the boxers to hit the opposite boxer, is harmless, and an extensible joint in form of an element assembly 4 constructed of upper and lower stiff elements 8 and 9, which connect the base 2 to the buffer 3 and in FIG. 1 is schematically illustrated by a broken line 4'.

During the harmless boxing match the boxers A,B can operate with their arms in the same way as in a real boxing match or in other ways as they prefer, and they do not need to activate and trigger other devices to move the buffer forward.

The boxer A thus, as seen in FIG. 1, holds the right arm in a retracted state ready to launch a punch with the boxing device 1*a* in a collapsed starting position.

With the left arm the boxer A simultaneously pushes the element assembly 4 with the buffer 3 into the direction of the opposite boxer B.

The boxer B uses the forward movement of the right arm to push the element assembly of the boxing device 1*d* into the direction of the boxer A and makes it extend by virtue of the propulsive force from the arm movement. The right hand holds onto the base 2, which is pushed forward, after which the movement of the base 2 comes to stop, but the element assembly can proceed to extend if not yet fully extended. After having stopped the pushing forward movement of the base 2 with the hand, and thereby of the element assembly 4 and the buffer 3, the boxer B retracts the left arm to the starting position which also causes the element assembly 4 to retract to its collapsed condition.

The element assembly 4 has one length in the starting position before launching a punch and a temporary larger length after launching a punch whereby the temporary larger length can be extended to a maximum length in dependence of the arrangement of the element assembly 4 and the base 2.

In one set up and game the boxers A,B may not cross the borderlines b or safety lines during the boxing match. But they could place themselves close to the borderlines b for having as little a distance d as possible to overcome when trying to hit the opposite boxer with the buffer 3.

The opposite boxer A,B could however step a bit back from the borderline/safety line b or selected distance d thereby trying not to be hit by a launched punch.

The boxers A,B may move around to perform the boxing match without borderline/safety lines b observing the mutual distance d, and rules for not harming each other.

The maximum length of the temporary larger length of the element assembly 4 is e.g. determined by the fact that a boxer A,B can push the element assembly 4 with the buffer 3 so far, when launching a punch, that the buffer 3 will touch the target. In case of a borderline/safety line b the boxer A,B can e.g. be situated about 50 cm, preferable about 25 cm and especially about 15 cm from the outside of the opposite borderline b, or with similar distance to the target.

The risk of harming a target or destroying the boxing device 1 is further alleviated or even eliminated because in response to impact with the target the element assembly 4 will immediately begin to retract by itself, because the present invention does not require activation or deactivation of triggers or change of grip. Further due to the element assembly 4 being configured to auto-retract at the end of the punch the boxing device 1 is promptly ready for the next punch.

Figure 2:
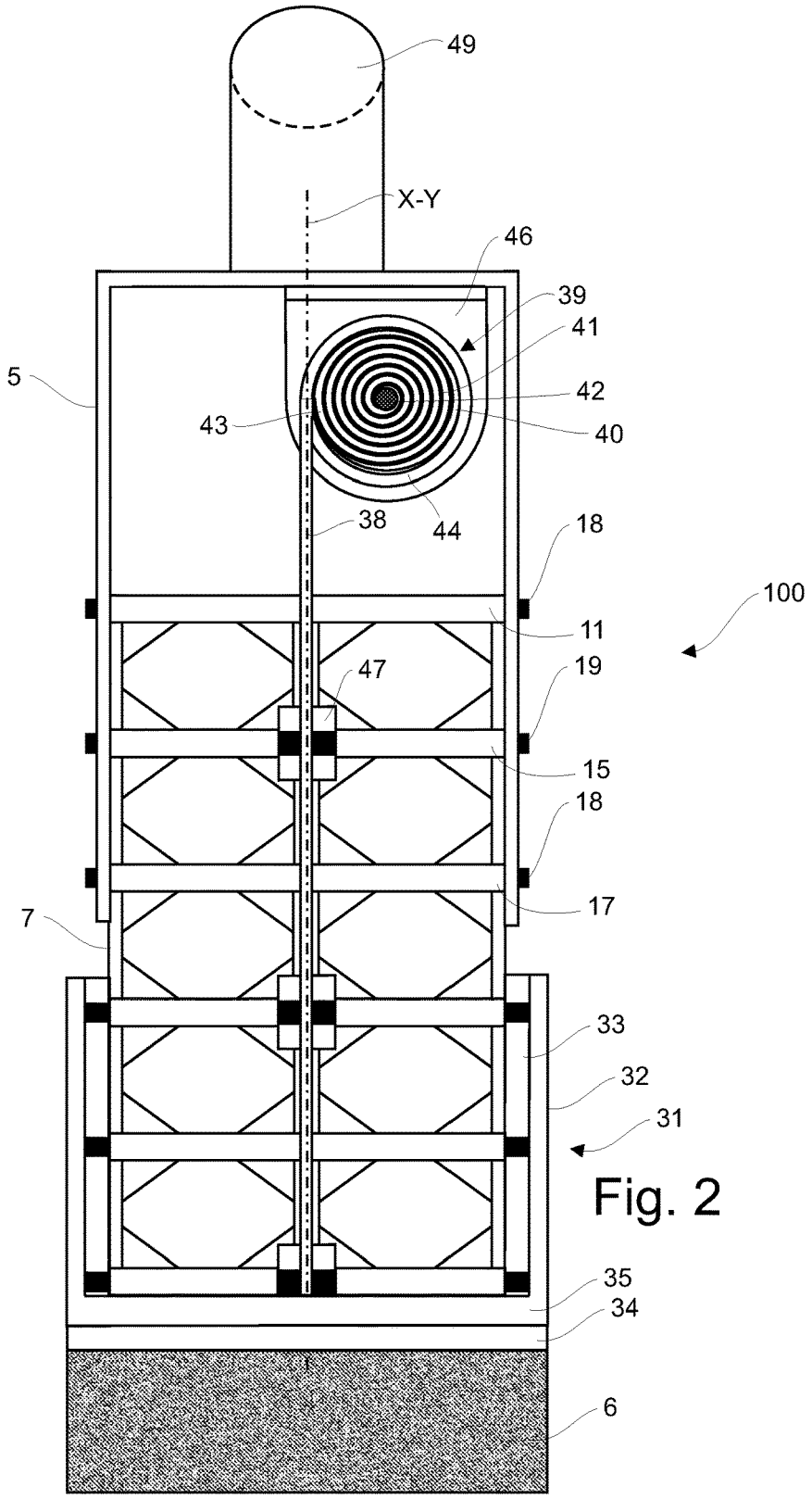
FIG. 2 is a sectional view, seen from above, of a first embodiment of the boxing device according to the invention.
Figure 3:
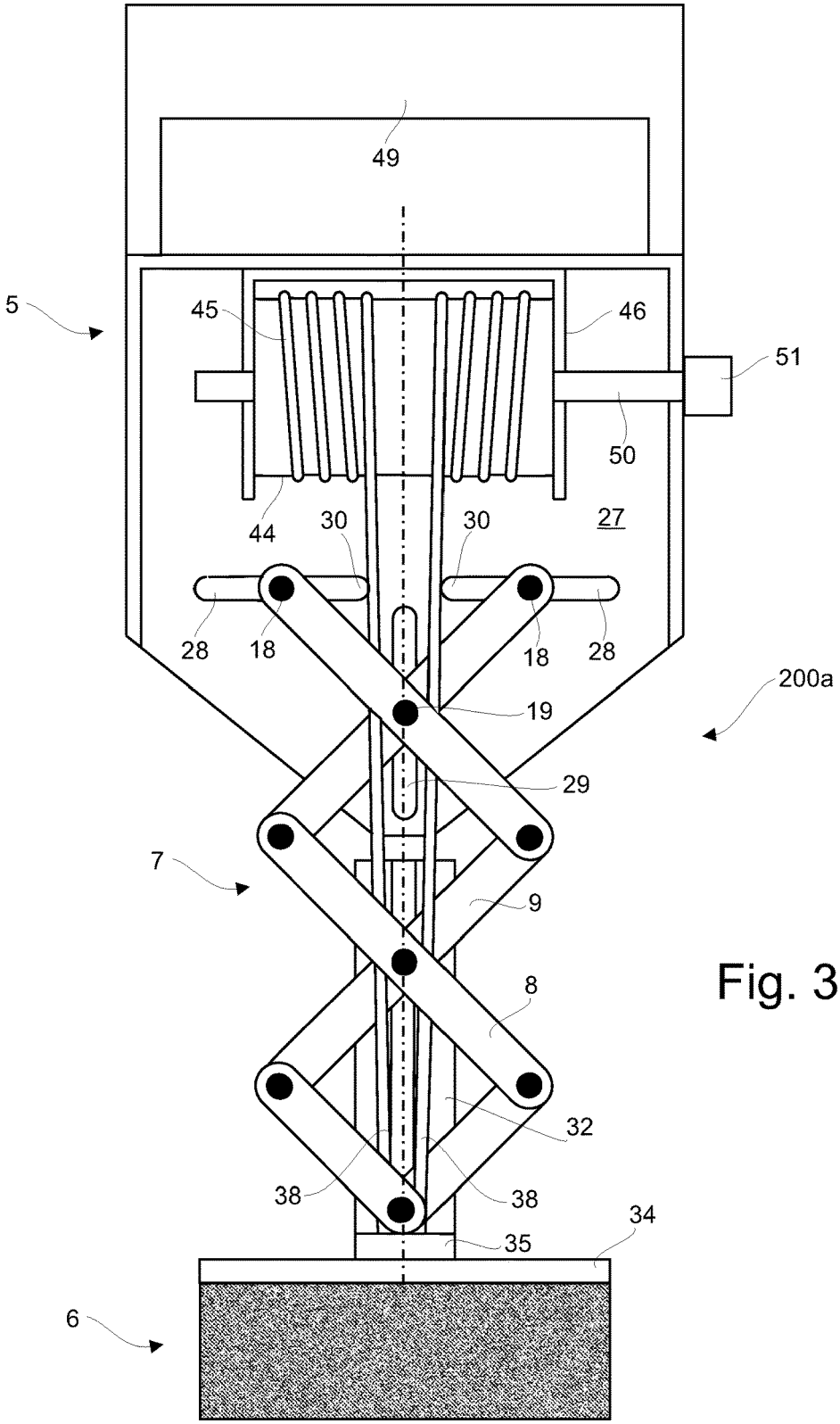
FIG. 3 is a sectional view, seen from the side, of a first variant of the boxing device shown in FIG. 2.
Figure 4:
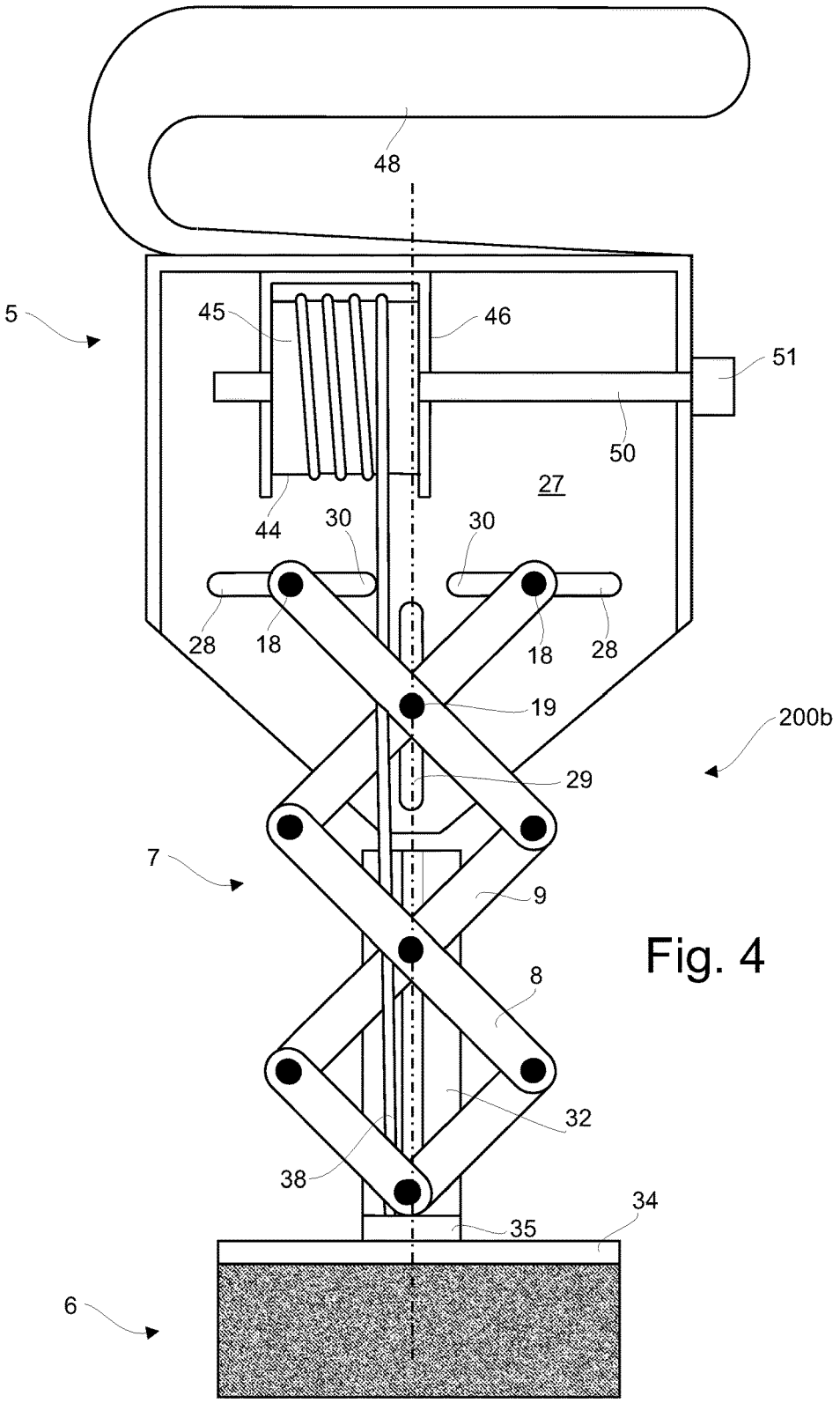
FIG. 4 is a sectional view, seen from the side, of a second variant of the boxing device shown in FIG. 2.

FIG. 2 is a cross section, seen from above, of one embodiment of the boxing device 100 according to the invention, and FIGS. 3 and 4 are cross sections of variants 200*a*,200*b*, respectively, of this embodiment of a boxing device 100, respectively, seen from the side.

Only a few extension elements in form of upper and lower elements 8 and 9 of the element assembly 7 are shown in the figures. The element assembly 7 may however have a larger number of extension elements in dependence of the length and number of upper and lower elements. When the length of each extension element is e.g. 7 cm, the number of upper and lower elements 8 and 9, respectively is e.g. between 7 cm and 12 cm.

Figure 5:
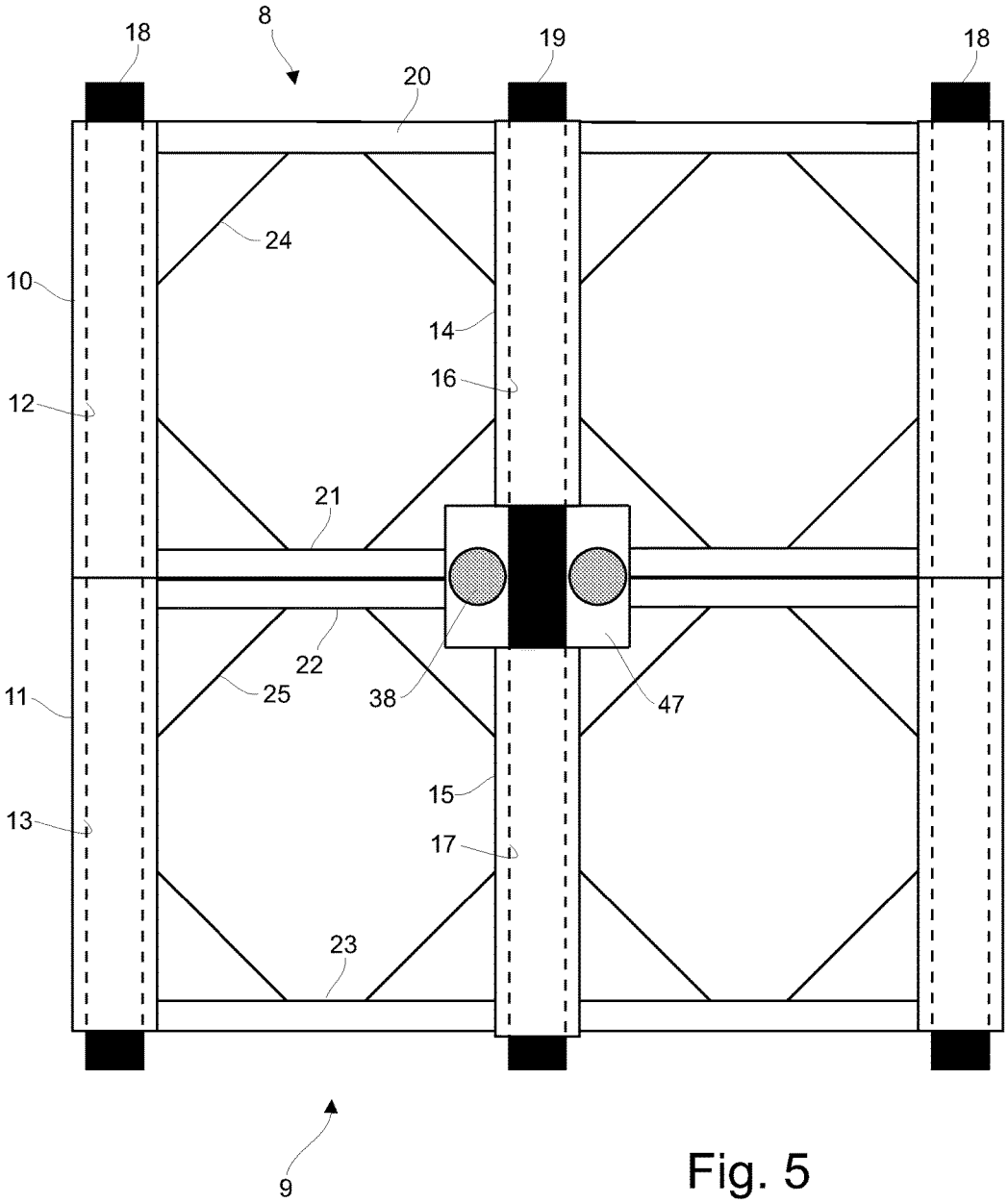
FIG. 5 shows in a larger scale, seen in front view, two first elements of an element assembly of the boxing device shown in FIG. 2, assembled on top of each other.
Figure 6:
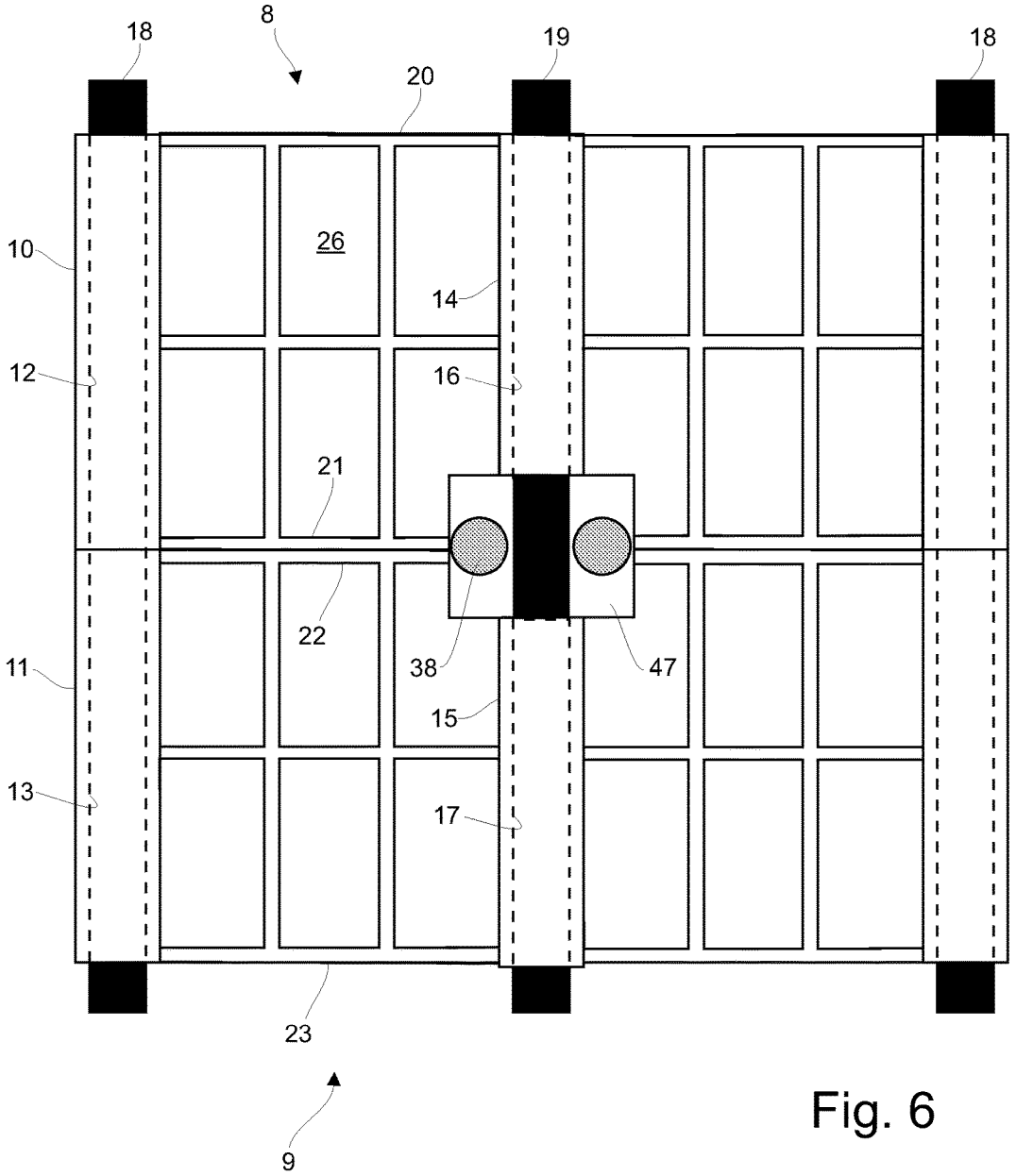
FIG. 6 shows in a larger scale, seen from in front, two seconds elements of a second element assembly of the boxing device shown in FIG. 2, assembled on top of each other.

FIG. 5 shows in a larger scale, seen from the front, an upper and lower element 8 and 9 of the extension elements of the element assembly 7 assembled on top of each other. The elements 8 and 9 are formed with two side tubes 10 and 11, receptively with side bearings 12 and 13 and with one central tube 14 and 15 with central bearings 16 and 17 and are assembled by means of side axles 18 in the side bearings 12 and 13 and a central axle 15 in the central bearing 16 and 17.

The side tubes 10 and 11 are connected with the central tubes 14 and 15 by means of upper and lower bars 20,21 and 22,23. A strengthening plate 24 and 25 is attached to the respective element in the corners between the tubes and the bars, or alternatively a number of sash bars 26 extend between the tubes and the upper and lower bars.

In a preferred embodiment the tubes, the bars and the strengthening plates or the sash bars are cast in one piece of a suitable material like e.g. plastic, such as a thermosetting plastic material that maintains a rigid, 3-D structure after curing.

As seen best in FIG. 2 the upper 8 and lower elements 9 of the element assembly 7 are moreover formed with central openings 47, and a string 38 is carried through a central opening 47 at each side of the central axle 19, the purpose of which will be further explained later.

According to the invention the base 5 and the element assembly 7, as seen in FIGS. 2, 3 and 4, are aligned along common axis x-y, which points towards the target, e.g. an opposite boxer, when launching a successful punch, and as mentioned above the element assembly 7 is formed as a row of upper and lower elements 8 and 9 that connect the base 5 with the buffer 6.

The elements 8,9 of the row of elements of the element assembly 7 are extensible in relation to each other. The row of elements is in the starting position before launching a punch, so it has a short length and a large width. After launching the punch the element assembly 7 gets a longer length and a shorter width.

Opposite walls 27 of the base 5 are formed with two side recesses 28 extending perpendicular to the x-y axis and with one central recess 29 extending along the x-y axis, in the present embodiment to make sure that the longitudinal axis of the extensible row of elements 8 and 9 of the element assembly 7 always is kept safely in line with the x-y axis of the base 5 so that auto-retraction and extension can take place unobstructed and fast.

A side axle 18 is meshing with each of the side recesses 28 while a central axle 19 is meshing with the central recess 29 so that the side axles 18 need to move perpendicular to the x-y axis and the central axle 19 along the x-y axis whereby that advantage is obtained that the axis of the base 5 and of the axis of the extensible row of elements of the element assembly 7 always will be in line with each other.

The side recesses 28 serve to stop the lateral movement of the respective side axles 18, so the side recesses 28 are also the means that eventually defines the maximum possible extended length of the element assembly 7.

The innermost ends 30 of the side recesses 28 are, according to some embodiment of the invention, situated in such a way on the walls 27 of the base 5 that the side axles 18 are stopped by the recesses 28 before the width of the extensible row of elements 8,9 of the element assembly 7 has been as short as possible since the element assembly 7 in that case will not be able to withstand larger lateral stresses without unacceptable side deflections.

Emphasise is made that embodiments with just one wall body are within the scope of the present inventions. Similar applies for embodiments with one side recess, embodiments with or without central recess, as well as embodiments having other angularly oriented side recesses, such as e.g. side recesses slightly inclined relative to the longitudinal axis x-y. The combination, angling and location of the recesses and meshing axles defines the way the boxing device can extend and auto-retract as well as the maximum width and length of the extensible joint.

A boxer participating in a harmless boxing match tries to hit the opposite boxer when launching a punch, but according to the invention the buffer 6 is arranged in such way that the opposite boxer is not really harmed.

The buffer 3,6, is made of a sufficiently soft material, for example cellular rubber and has a size large enough to secure that the buffer 3,6 cannot penetrate the eyes of the boxers. The buffer can also be in form of a semisphere, e.g. of soft rubber or leather, being distended at the terminal end of the element assembly 7, or can be a soft inflated ball. In fact the buffer 3,6 can be any object that can yield at the impact with the target to absorb impact energy and force.

Preferably the buffer 3,6 can have the same x-y axis as the base 5,6 and the row of elements 8 and 9 of the element assembly 7 for being able to satisfactorily hit the target, such as an opposite boxer A,B, with a punch as desired.

That axial orientation of the buffer 6 can be established by means of an U-formed clamp 31, which best can be seen in FIG. 2.

The clamp 31 has two legs 32 with slots 33 meshing on the outside of the element assembly 7 with at least two central axles 19 in all positions of the element assembly, whereby the buffer 6 is fastened upon a plate 34 which again is fastened on the foot 35 of the U-formed clamp 31.

The element assembly 7 with the buffer 6 forms, in the extended state, a relatively long beam, which is restrained in the base 6 and may bend more or less down by the gravity whereby the precision, by which the boxer can operate the boxing device, is reduced.

How much the free end of a restrained beam goes down when being influenced by gravity depends on the moment of resistance against deflection of the beam.

Figure 7:
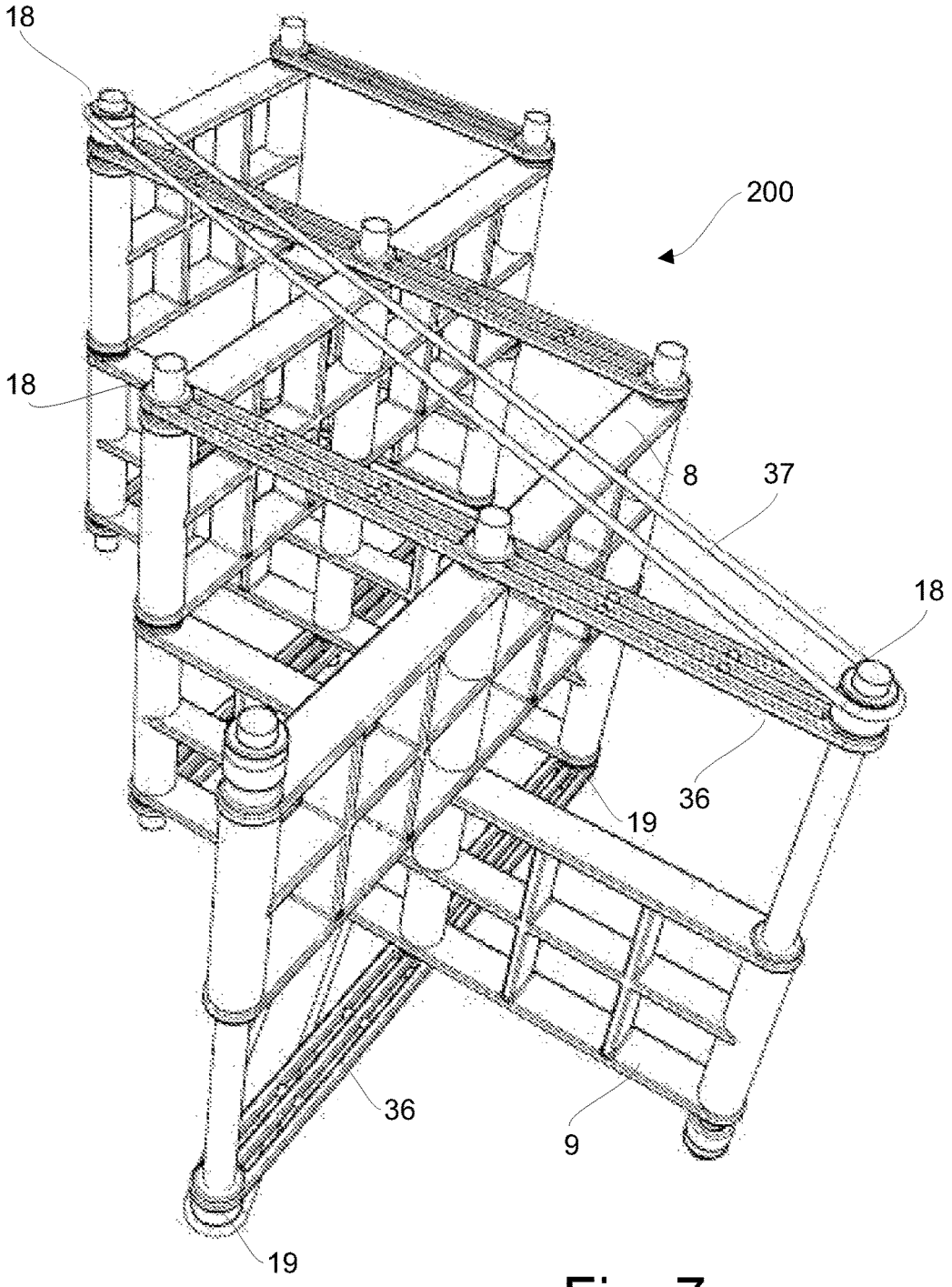
FIG. 7 is a perspective view of a fragment of the element assembly of the boxing device shown in FIG. 2.

FIG. 7 is a perspective view of a fragment of a row of extension elements of the variant of a boxing device 200, as exemplified by schematic embodiments 200*a*,200*b*, which owing to the mathematical proportion between the width and the moment of resistance against deflection of the upper element 8 and the lower element 9 of the element assembly 7 have a relatively large height.

The upper element 8 and the lower element 9 are interconnected to extension elements by means of the side axles 18 and central axle 19, but only in the areas where they face each other, not at top and bottom, whereby the moment of resistance against being bent is reduced, e.g. to about a quarter of the moment of resistance which the element assembly 7 would have had if account could have been taken of the total height of the element assembly 7.

If the materials and the structure of the element assembly 7 do not in itself remedy this drawback, it may be beneficial to, on top and bottom of the element assembly 7, connect a strengthening bar 36 with the side axles 18 and the central axle 19, which axles serve for assembling each pair of upper element 8 and lower element 9 into an extension element, as seen in FIG. 7. The moment of resistance of the element assembly is thereby substantially increased even if the thickness of the strengthening bar 36 is relatively small.

The moment of resistance of the element assembly 7 can be further increased by on top and bottom of the element assembly 7 using a number of elastics 37 to connect two side axles 18 at each their respective side of at least one upper element 8 or lower element 9 of the extension element of the element assembly 7. The elastics 37 also increases tendency to flex, thus the ability that the element assembly auto-retracts and returns to it's collapsed configuration after it has been extended.

During the harmless boxing match the boxer uses energy to launch the punches. This energy is converted to propulsion of the element assembly 7, and thus of the buffer 3,6, so as to imitate a real boxing match, albeit with the hitting component, the buffer, much more distanced from the boxer. Launching a punch causes the element assembly 7 to take over some or all of the energy put in a punch of the boxer thereby increasing the length of the element assembly 7.

A spring arrangement 39 with the string 38 is fastened to the base 2 while the end part of the string 38 is fastened to an end part of the element assembly 7.

The spring arrangement 39 immediately withdraws the element assembly 7 to its starting position when the extension of the element assembly 7 is mechanically/physically stopped, and/or when all of the supplied energy from the propulsion has been used.

In an expedient embodiment of the invention the spring arrangement 39, as seen in the FIGS. 2,3,4, comprises a spiral spring 40 with a number of windings 41 of which an inner winding 42 is fixed to the base 2 and an outer winding 43 is fixed to a spool 44, which spool is rotatable mounted onto the base 2 via a holder 46, and around which spool 44 a number of windings 45 of the string 38 are wrapped.

This construction of the spring arrangement 39 allows the string 38 and thereby the element assembly 7 easily to extend one meter or more.

Using a single string 38 carried through the central openings 47 at one side of the central axle 19 provides a bending moment acting only upon the element assembly 7.

An exemplary handle 48, e.g. as shown in FIG. 4, can be closed at one end and open at the opposite end. The handle 48 is mounted to the base 2 so that the boxer spontaneously will keep the boxing device in a position where the string 38 is above a central axle 19 so that the bending moment resulting from the string 38 acting upon the element assembly 7 turns upwards to at least partly neutralizes the downwards bending moment resulting from the gravity acting upon the element assembly 7.

The spring arrangement 39 of the boxing device shown in FIG. 3 is equipped with two strings 38 pulled through the central openings 47 at each their side of the central axles 19. Since the bending moments by which the strings 38 are acting upon the element assembly 7 thereby are neutralizing each other the handle 49 of the boxing device can be formed as shown in FIG. 3 instead of as shown in FIG. 4.

FIGS. 3 and 4 also show that the strings 38 are pulled through the openings 47 (not seen in FIGS. 3 and 4) between the upper elements 8 and lower elements 9. Only the spool 44 can however be seen in these figures as the spiral spring 40 is placed inside the spool 44.

Above is explained that the inner end 42 of the windings 45 of the spiral spring 40 is connected to the base 2 via the holder 46. FIGS. 3 and 4 show that said connection takes place via a turnable rod 50, which is connected with the inner end 42 of the windings 45 of the spiral spring 40 and with an adjusting button 51 outside the base 2.

By turning the adjusting button 51 the spring tension of the spiral spring 40 can easily be adjusted to fit to the physical power of a specific boxer participating in a harmless boxing match.

The father to e.g. a little boy, who enjoys the game of a harmless boxing match, thus also can adjust the spring tension to fit to the physical power of the growing boy, and boxers of different physical capability can box against each other.

The FIGS. 8-13 show a second embodiment of a boxing device 300 according to the invention. The second embodiment consists of three element assemblies 52 connected lengthwise along adjacent sides so that the cross-sectional outline becomes triangular and delimits a large central opening 47' along the length.

Figure 8:
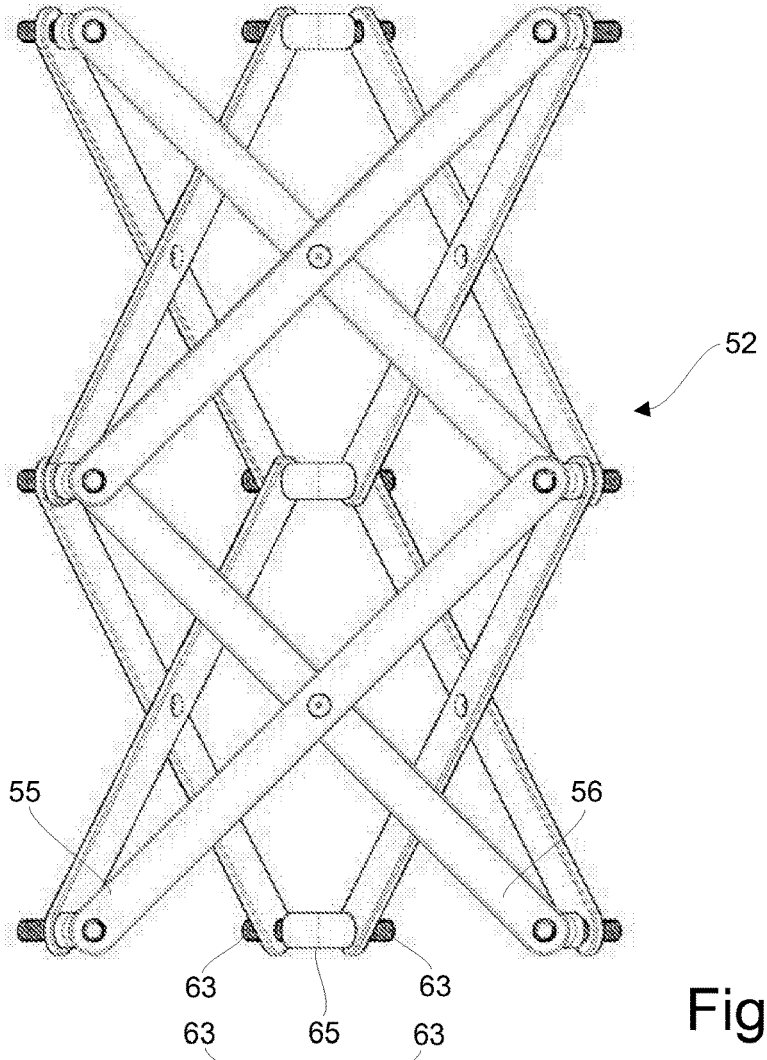
FIG. 8 is a perspective view of a fragment of the extension elements of an element assembly of a second embodiment of a boxing device according to the invention.
Figure 9:
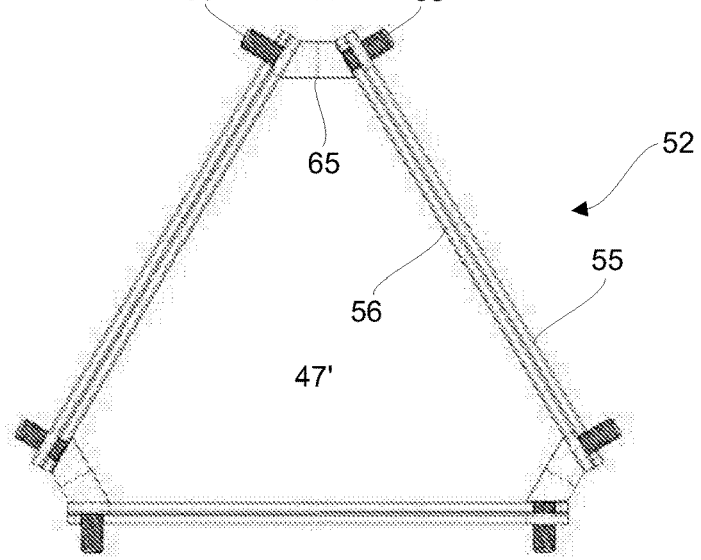
FIG. 9 shows the same, seen from above.

FIG. 8 is a perspective view of a fragment of the structure of the second embodiment of the boxing device 300, and FIG. 9 shows the boxing device 300 seen from above seen along the longitudinal axis of the three assembled element assemblies 52.

Figure 10:
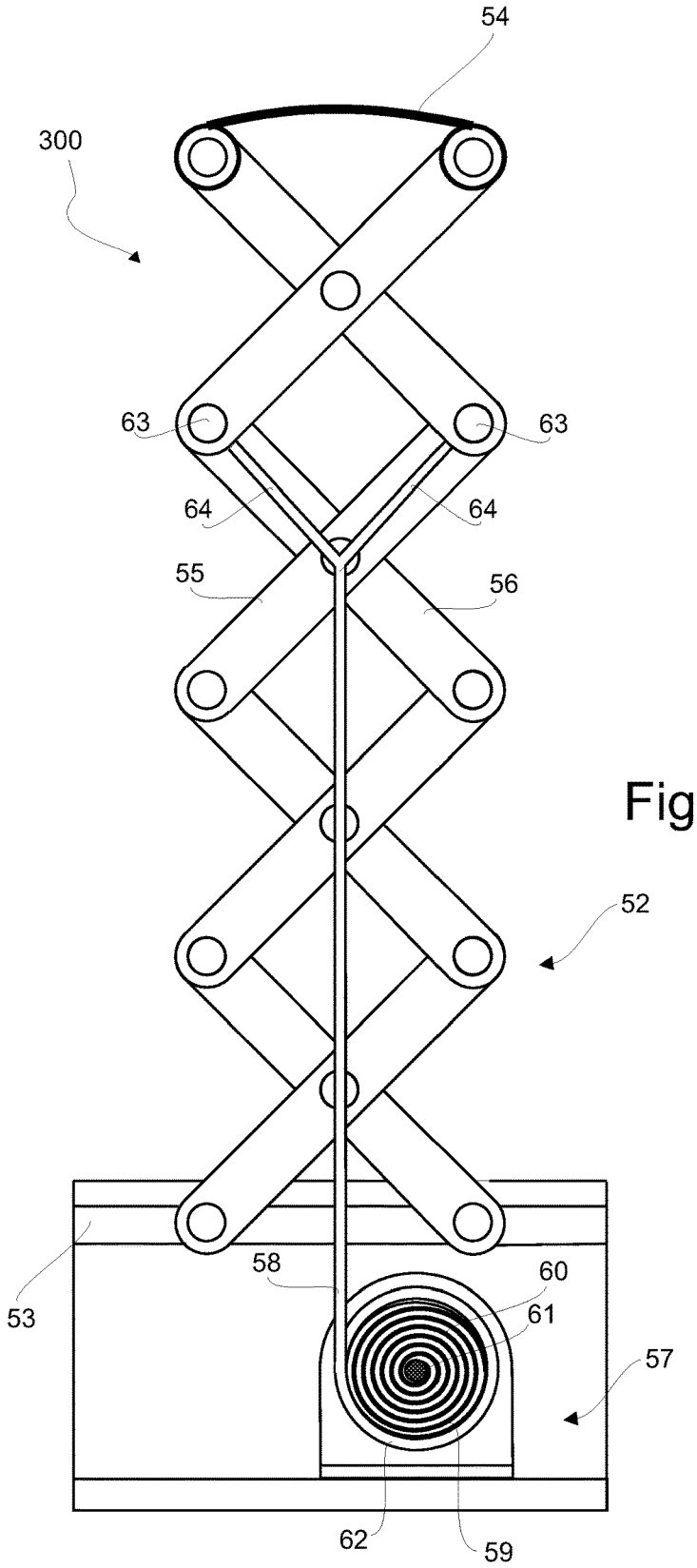
FIG. 10 shows schematically, a longitudinal section of a second embodiment of the boxing device according to the invention, seen from the side.

FIG. 10 shows schematically a longitudinal section of the second embodiment of the boxing device 300, seen from the side, comprising a base 53, a buffer 54, and the element assembly 52 in form of an extensible assembly comprising extension elements in form of rows of upper elements 55 and lower elements 56, which element assembly 52 connects the base 53 to the buffer 54.

Figure 11:
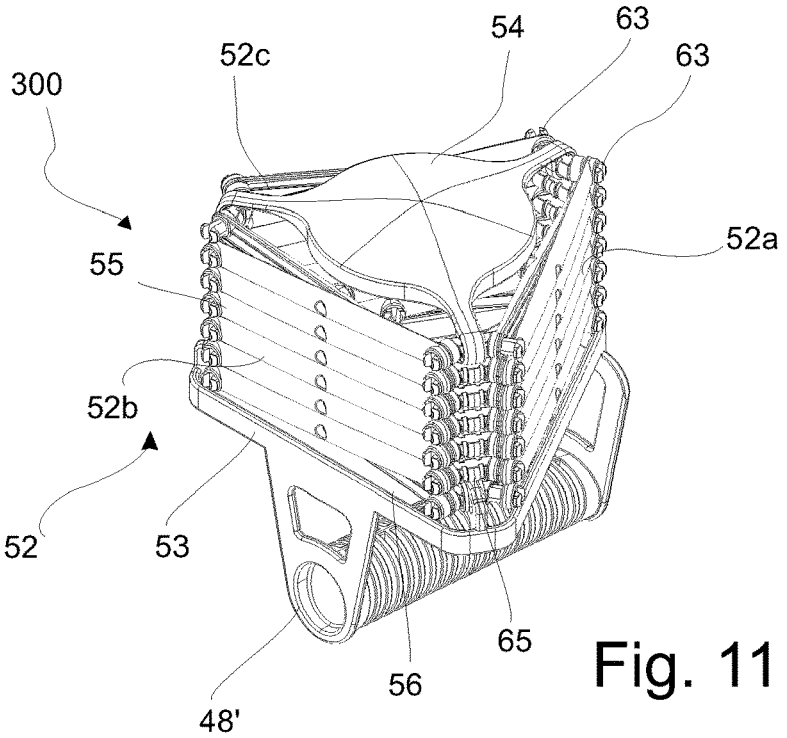
FIG. 11 is a perspective view, seen from the buffer of the triangular second embodiment in collapsed condition.
Figure 12:
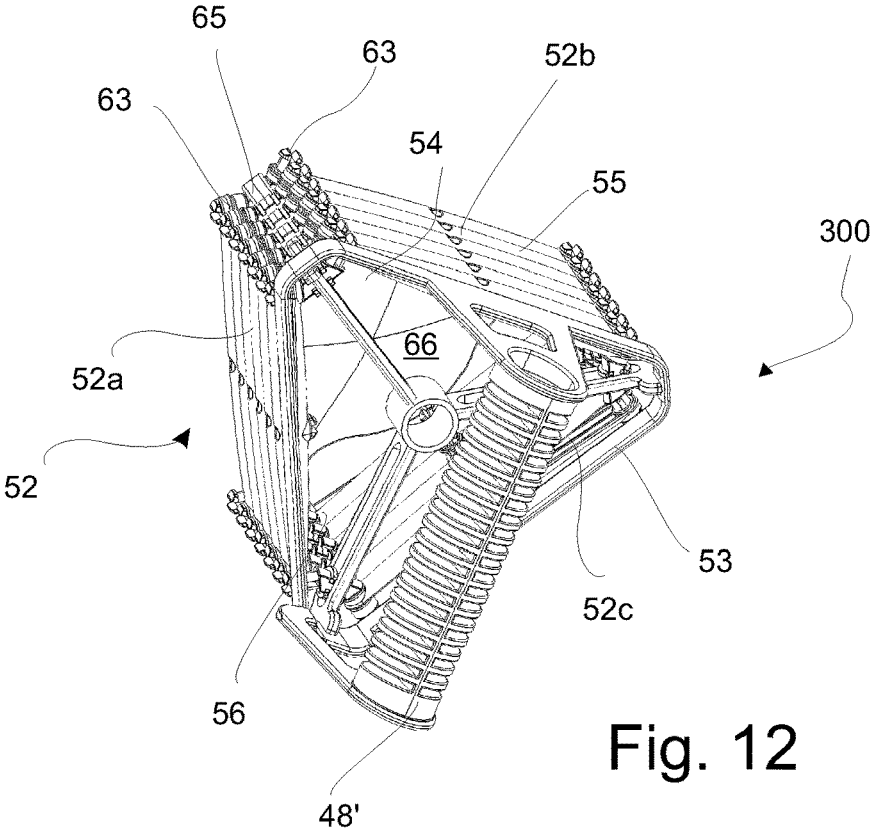
FIG. 12 shows the same but from the base and the handle.
Figure 13:
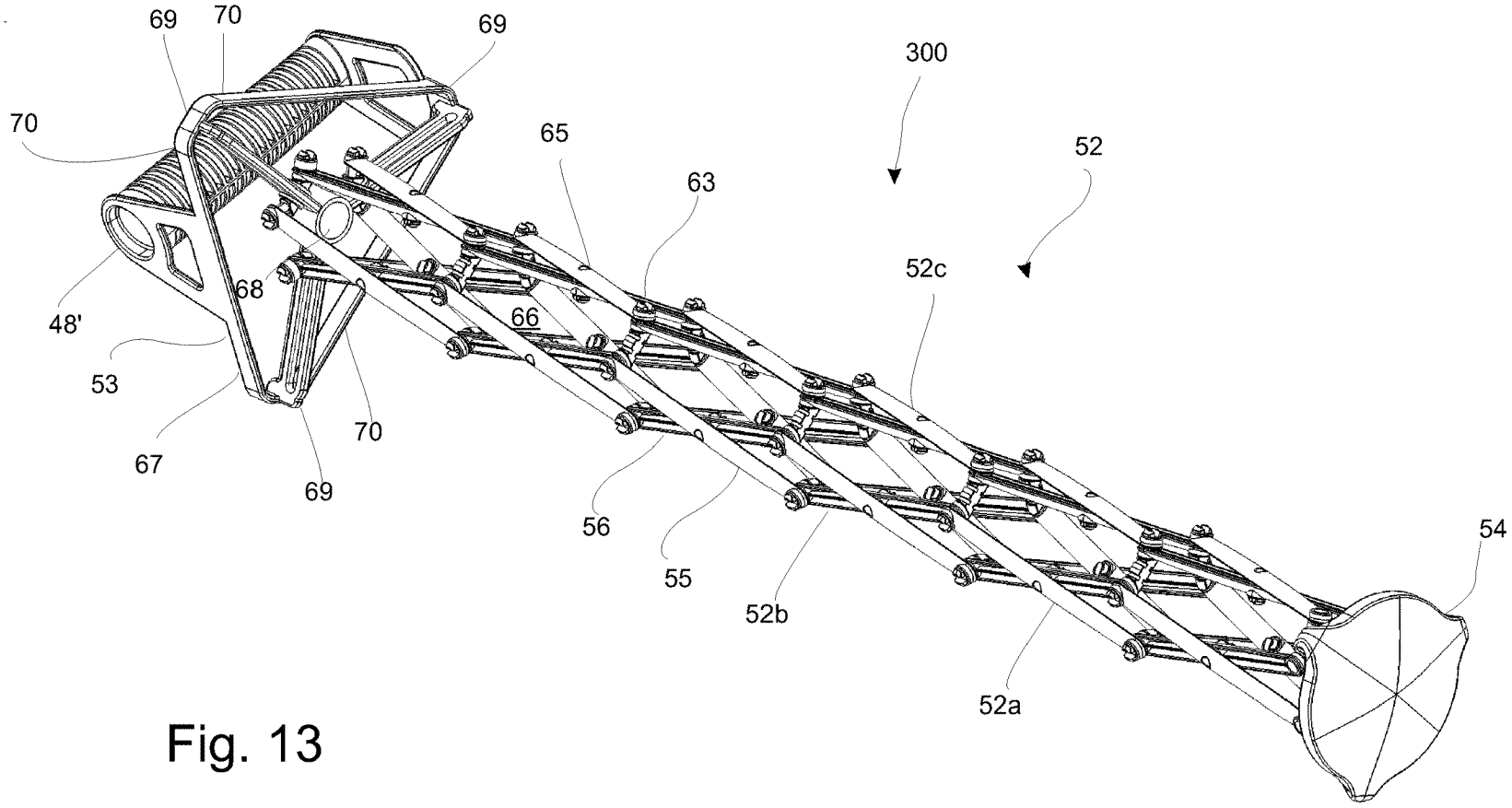
FIG. 13 is a perspective view of the triangular second embodiment in extended condition.

FIG. 11 is a perspective view, seen from the buffer 54 of the triangular second embodiment of a boxing device 300 in collapsed condition of the element assembly 52 prior to a punch. FIG. 12 shows the same but from the base and the handle. FIG. 13 is a perspective view of the triangular second embodiment in extended condition of the element assembly 52 at the end of a punch. In FIG. 13 the element assembly has been completely extended.

Spring arrangement and string are only visualized in FIG. 10. In FIGS. 11, 12 and 13, which merely shows the configuration of the second embodiment of a boxing device 300 in collapsed and extended positions, the spring arrangement and strings are not visible.

As seen in the schematically longitudinal section of FIG. 10 the triangular element assembly 52 comprises a spring arrangement 57 with a string 58 for withdrawing the triangular element assembly 52 to the starting position, thus to retract the triangular element assembly 52 towards the base 53 at the end of the punch.

The base 53 is a triangular frame 67 with a centre guide tube 68 connected to three vertices 69 of the triangular frame 67 via stiffening rods 70. The string 58 extends from the spring arrangement at the base 53 through centre guide tube 68 via the large central opening 66 delimited by the combined sub element assemblies 52*a*,52*b*,52*c* of rows of extension elements 55,56 of the element assembly 52, and connects to opposite side axles 63 situated at the end, or close to the end, of the element assembly 52 by means of connection strings 64. The three rows 52*a*,52*b*,52*c* are mutually and flexible connected by bridge member 65 at side axles 63 to provide for the extension property of the inventive boxing device 300.

The connection strings 64 may form an angle with each other corresponding to the angle which an upper element 55 and a lower element 56 of the element assembly form with each other, thereby securing that the element assembly always is withdrawn by auto-retraction to the starting position after a punch has been launched and the extension of the element assembly has stopped and safely is kept there until next time a punch is launched. The string 58 can be secured at the end of the triangular element assembly 52 in any other way, e.g. at a central axle, or to another part of the distal upper element 55 or lower element 56. Connection strings are not mandatory. One connection string or more connection strings can be used.

As seen in FIG. 10 the spring arrangement 57 comprises a spiral spring 59 with a number of windings 60 of which an inner end 61 of the windings is fixed to the base 53 and an outer end is fixed to a spool 62 rotatable mounted on the base and around which a number of windings of the string 58 are wrapped or can be wrapped.

Each of the three element assemblies 52*a*,52*b*,52*c* consists in this case of relatively thin upper elements 55 and lower elements 56. Two adjacent element assemblies 52*a*, 52*b*,52*c* are assembled to each other at two opposite side axles 63 via a bridge member 65. The exemplary bridge member 65 has, in the present exemplary embodiment, inclined sides, which form an angle of 60° with each other when the three element assemblies 52*a*,52*b*,52*c* form an equilateral triangle with each other.

The second embodiment of the boxing device 300 has a large bending moment owing to its triangular shape and is therefore very stable to operate.

Other polygonal cross-sectional shapes can be composed similarly by providing more than three element assemblies 52. Polygonal shapes that include an uneven number of element assemblies may be preferred. Embodiments including a one-rowed element assembly of extension elements are possible within the scope of the present invention although for long extension it may not be preferred.

Figure 14:
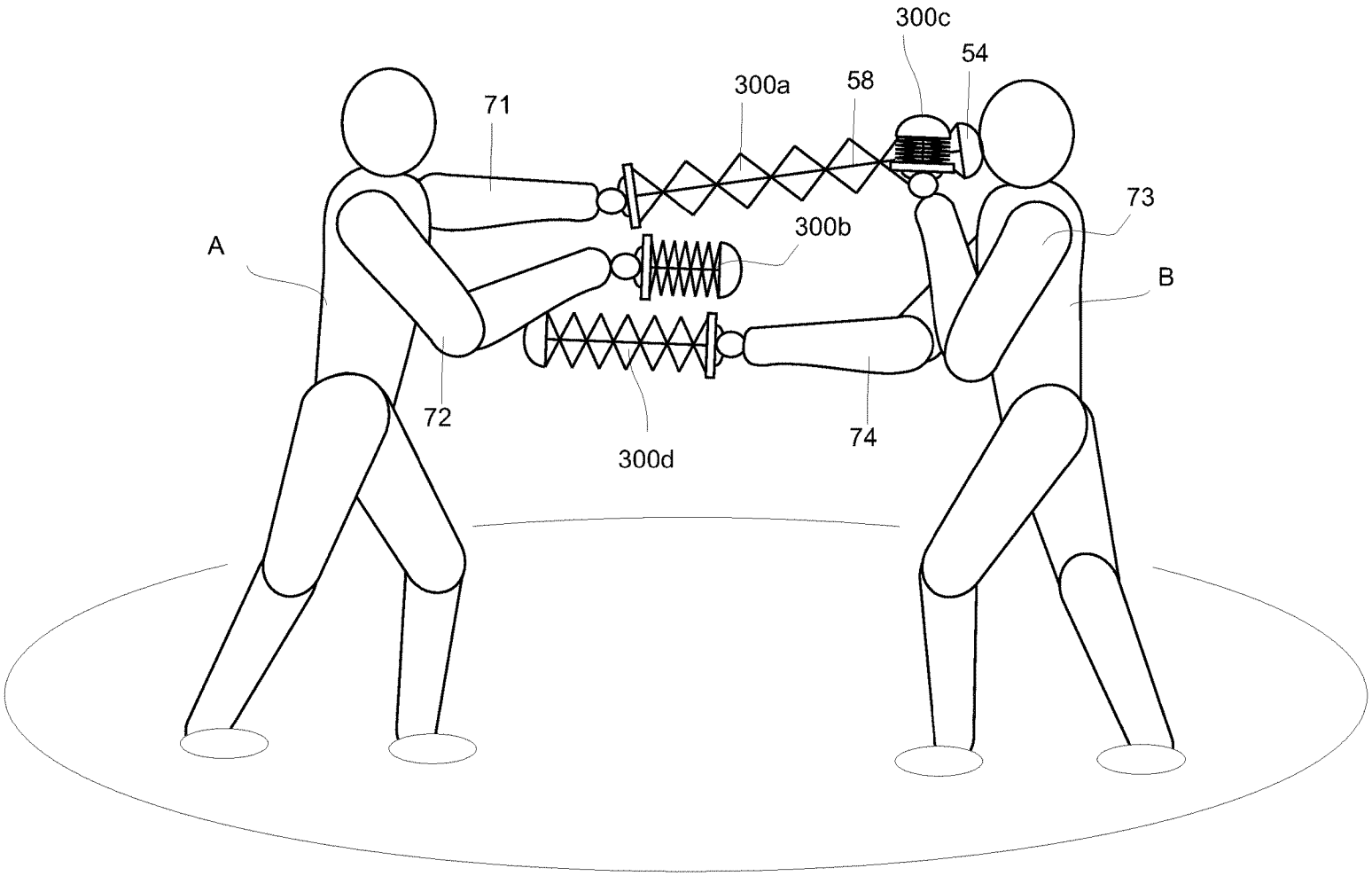
FIG. 14 illustrates how two boxers box against each other using the second embodiment of a boxing device shown in FIGS. 10-13.

FIG. 14 illustrates how two boxers A,B box against each other using the second embodiment of a boxing device 300 shown in FIGS. 8-13. The two boxers A,B move around at a safety distance from each other so that they do not harm each other, but moves so that they act almost like in a real boxing match.

Boxer A has moved his left arm 71 forwards and extended the boxing device 300*a* to hit boxer B gently with the buffer 54. Boxer A's right arm 72 is being returned whereby boxing device 300*b* auto-retracts to be ready for the next punch. Boxer B defends himself using his left arm 73 to protect him whereby the boxing device 300*c*, which he holds, becomes fully collapsed and can be extended by virtue of propulsion when boxer B makes his next move to hit boxer A. Boxer B has already extended the boxing device 300*d* in his right hand 74 in an attempt to hit boxer A.

Figure 15:
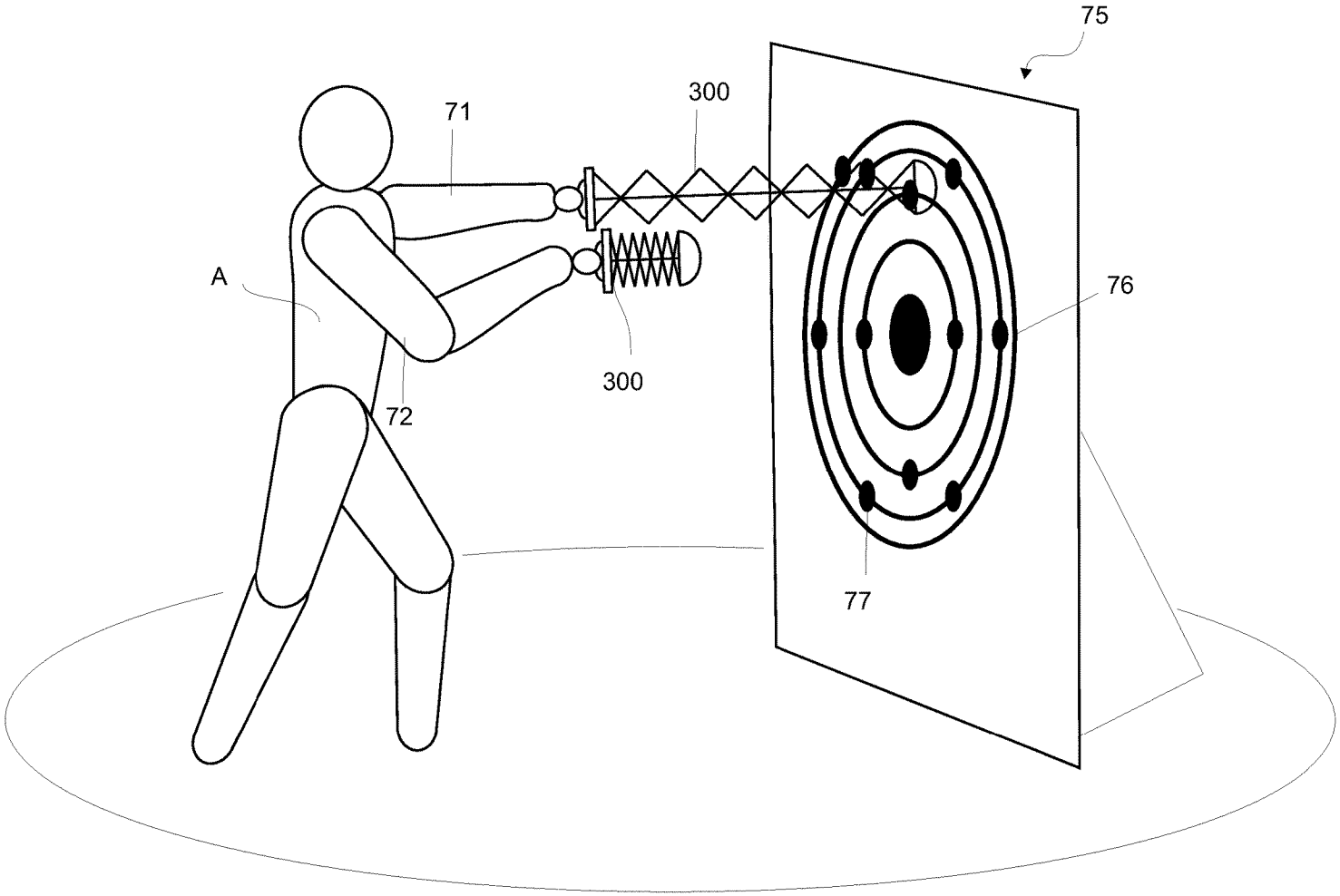
FIG. 15 illustrates a boxer boxing against another target than another boxer.

In FIG. 15 boxer A boxes against a stationary object in form of a poster or hit screen 75 or touch screen. The hit screen 75 has one or more targets 76 with different hitting points 77 of none, or various or same scores. The hit screen 75 may include sensors (not shown) behind each hitting point 77 that register that a specific hitting point 77 has been hit. An electronic signal can be issued as well as another electronic signal can be transmitted to a computer appropriately equipped with software to register and accumulate the score, provide statistics of hits etc.

A modified handle 48' is mounted to the base 53 and serves to operate the second embodiment of a boxing device 300 very easily. The modified handle 48' has a ribbed grip to further prevent the boxer from loosing the grip at the handle 48'.

Various hits of targets on hitting screens may be available for different users. E.g. a child might like to perform a game by hitting letters to spell different words of different complexity. The child might be encouraged by an additional visual or audible feature and equipment next to him/her to hit hitting points in a specific order and to hit those fast. The child may e.g. be told by a speaking programme or told by a display programme for the method of the present invention to spell a word by hitting the letters and this way improve spelling skill at the same time the child get exercise. The child can also improve math skills and any other skill this way. There is no limit for the features and the design of hitting screens. Any person of any age may improve skills and get exercise this way. Other targets can be recognition of features, such as animals, flowers, and national flags by e.g. hitting the appropriate ones in a certain order.

Any person can perform a game or match against another remote boxer via the Internet, the mobile network etc., provided the other person has access to the same features. The software for boxing against each other or against oneself may be available via an App of can be purchased together with the boxing device. If the user does not wish initially to invest in a special target the user can use any target he likes to get exercise, including shadow boxing.

Figure 16:
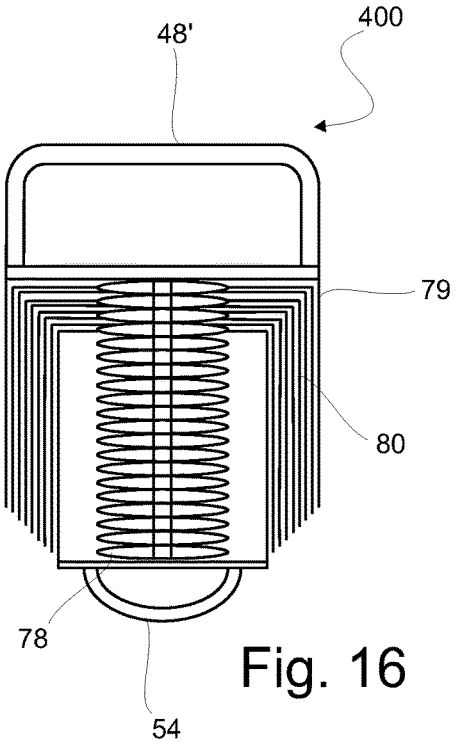
FIG. 16 is a sectional side view of a third embodiment of the boxing device according to the invention in collapsed condition in a starting position.
Figure 17:
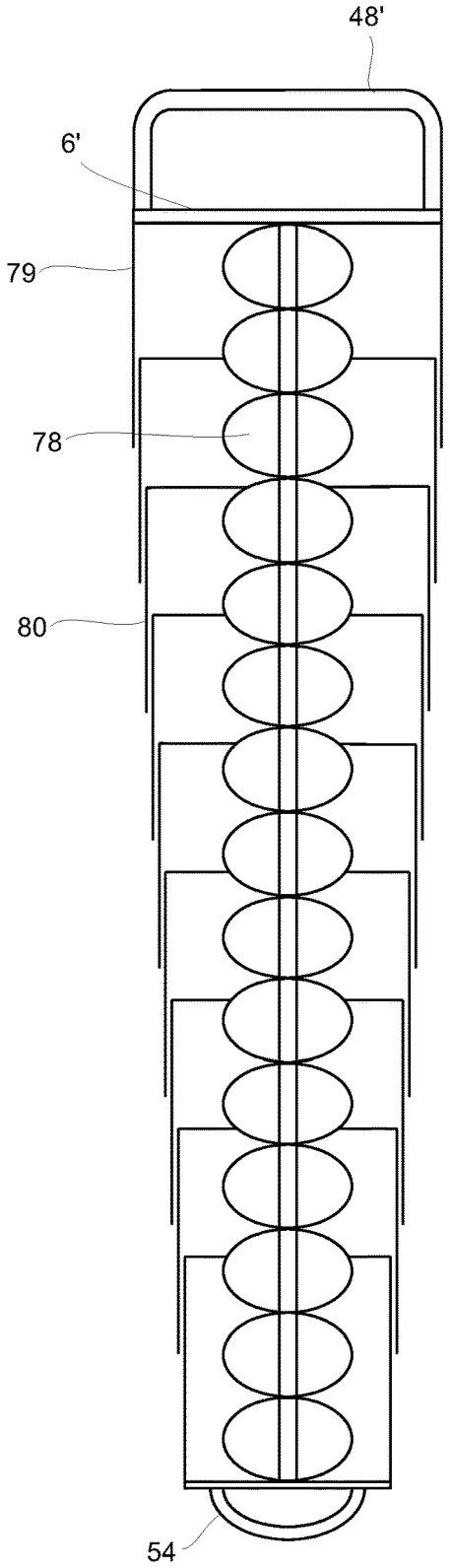
FIG. 17 shows the same in an end position in extended condition.

FIGS. 16 and 17 are sectional side views of a third embodiment of the boxing device 400 according to the invention in collapsed condition in a starting position and in an end position in extended condition, respectively.

This boxing device 400 consists of a the handle 48', a tension spring 78, a buffer 54 and an element assembly in form of a telescopic tube 79 composed of tube sections 80 having decreasing diameter towards the buffer 54. For the third embodiment 400 seen in FIGS. 16 and 17 nine tube sections are used.

The spring arrangement of this embodiment includes the tension spring 78 for retracting the buffer 54. The tension spring 78 consists of a row of interconnected spring elements 81, such as e.g. leaf springs hanging together like a chain.

The leaf spring can e.g. be of the kind having four arms but can within the scope of the invention have fewer or more arms, for example eight arms, or any other configuration suited to extend and auto-retract the telescope.

The base 6' is connected to the proximal end of the tension spring 78 at one end, and the buffer 54 is connected to the distal end of the tension spring 78. The tension spring 78 is mounted inside the telescopic tube 79.

The tube sections 80 of the element assembly, i.e. the telescopic tube 31, are movably engaging each other in such way that the telescopic tube forms a stiff structure in the extended position of the buffer 54.

Figure 19:
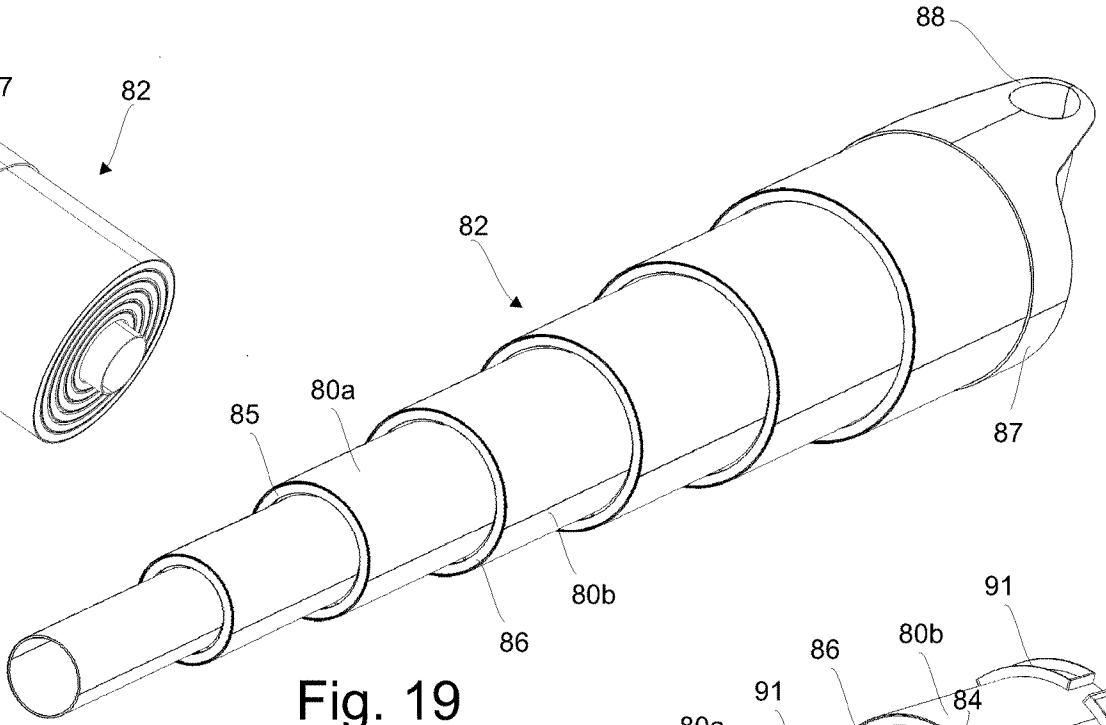
FIG. 19 shows the same in extended state.
Figure 20:
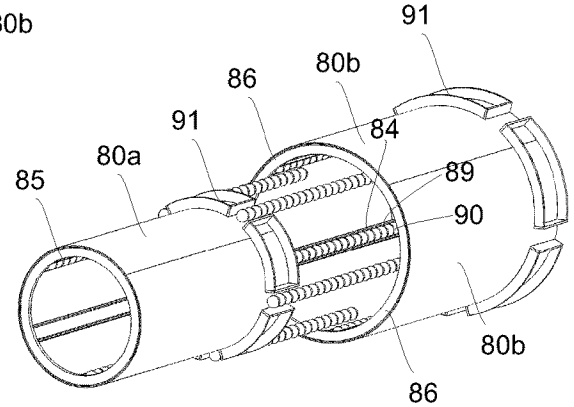
FIG. 20 is a fragmentary perspective view of two adjacent tube section of the telescopic extensible joint shown in FIG. 19 for a boxing device with visualized friction reducing means.
Figure 18:
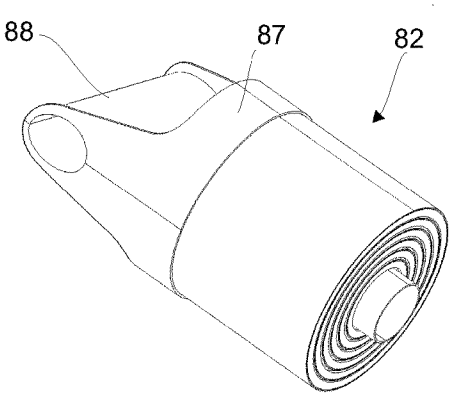
FIG. 18 shows a variant of an extensible joint in form of a collapsed telescopic extensible joint of a boxing device with friction reducing means.

FIGS. 18, 19 and 20 show a variant of a telescopic extensible joint 82 of a boxing device with friction reducing means. FIG. 18 shows the telescopic extensible joint of a boxing device in collapsed state, FIG. 19 shows the same in extended state, and FIG. 20 shows the friction reducing means of two adjacent tube sections of the telescopic extensible joint shown in FIG. 19.

The friction reducing means 83 is in form of a number, e.g. six as shown in FIG. 20, annularly distributed linear slide bearings 84 interposed between the walls of adjacent tube sections, as exemplified by opposite walls 85,86 of two consecutive tube sections 80*a*,80*b*, The linear slide bearing 84 is e.g. axially extending and radially protruding profiles 89 that accommodate a row of roller balls 90 that allow a small angular ball segment of the balls 90 to be free to slidingly contact the opposite wall of a tube section to allow a substantially friction-reduced contact and sliding between tube sections. The linear ball bearing 84 provides an essentially large contact surface resulting in an essentially lower surface pressure on the tube sections 80*a*,80*b* so that adjacent tube sections 80*a*,80*b* do not jam neither upon forward movement by propulsion, nor during auto-retraction by an extension and retraction mechanism, such as the exemplary extension and retraction mechanism seen in FIGS. 21-23.

The linear ball bearings 84 also create a space between adjacent tube sections 80*a*,80*b* so that wear, jamming and trapping due to sliding contact is substantially eliminated and galling avoided.

The base 87 is mounted to the tube section 80*c* having the largest diameter, which base 87 extends into a hollow handle 88 inside which electronic means can be placed, such as electronic means for registering hits and performing routines, participating in a game, etc. Annularly distributed spacers 91 on the external diameter of a tube section at that end of a tube section that is inserted inside a subsequent tube sections serve to keep respective subsequent tube section radially spaced apart, as illustrated in FIG. 20, sufficiently to provide space for the friction reducing means and allowing the unhindered extension and retraction of the telescopic extensible joint 82 between the state seen in FIG. 18 and the state seen in FIG. 19, as well as any intermediate state.

The telescopic extensible joint 82 is for illustrative purposes shown without buffer and extension and retraction means. It should be noted that such means of course are part of a boxing device that includes the telescopic extensible joint 82.

Although the extensible joint 82 is shown in FIGS. 18-20 without spring arrangement and buffer it should be understood that for use in a boxing device according to the present invention such are included.

Figure 21:
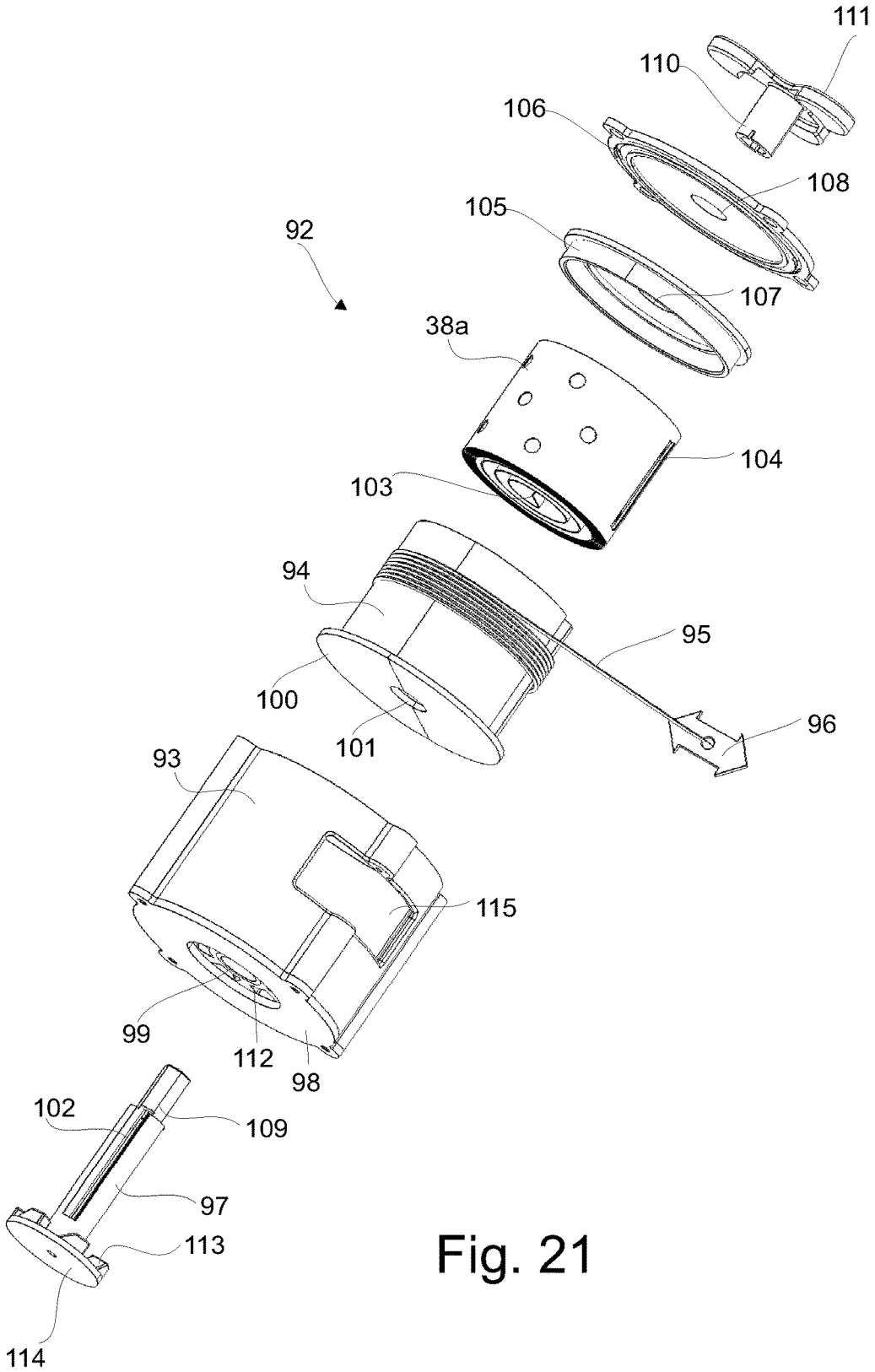
FIG. 21 is an exploded perspective view of a spring arrangement in form of a retraction and extension mechanism including a spring mechanism for the boxing device.

FIG. 21 is an exploded perspective view of an embodiment of a spring arrangement in form of a retraction and extension mechanism 92 including a tensionable spring mechanism for the boxing device.

The retraction and extension mechanism 92 is comprised of a tubular housing 93 inside which a hollow spool 94 can be fitted. The hollow spool 94 is provided with windings of a continuous retraction string 95, one end of which is secured to the spool 94 and the opposite end is secured to an anchor 96 for securing the retraction string 95 to a buffer or to e forward end of an extensible joint.

The tubular spring housing 93 has a bottom 98 with a bottom lock opening 99 and the hollow spool 94 has a base plate 100 with a base plate opening 101 aligned with the bottom lock opening 99 when the hollow spool 94 with the windings of continuous retraction string 95 is mounted in the tubular spring housing 93.

A slotted shaft member 97 is inserted into aligned bottom lock opening 99 and base plate opening 101 thereby delimiting a radial gap between interior wall of tubular spring housing 93 and hollow tubular spool 94. This radial gap provides an expedient confined space for the retraction string 95. The slotted shaft member has an axially extending spring receiving slot 102 for securing an inner end 103 of a spring **38*b* in relation to the tubular housing 93 and thus to the base. The opposite end 104 of the spring 38*a* is secured to the hollow spool 94, and due to the spring 38*a* being secured to the spring receiving slot 102 the spring 38*a* can coil and un-coil about the slotted shaft member 97. When a buffer moves forward in response to propulsion of said buffer due to the boxer moving his arm forward the spring 38*a* is tensioned and the string 95 is brought along with the buffer whereto it is secured. The string 95 is retracted from the extended position because the spring 38*a*** is inclined to return to the relaxed starting position, which is the position prior to extending the extensible joint when a punch is performed. So auto-retraction of the buffer of a boxing device follows inherently by the nature of the spring to coil whereby the spring auto-retracts the buffer.

The hollow spool 94 is capped by a first lid member 105 that holds the spring **38*a* inside the hollow spool 94. A second lid member 106 serves for capping the tubular spring housing 93. The lid members can be assembled to the tubular spring housing 93 to the base by fastening means, such as screws or glue (not shown). The first lid member 105 has a first lid opening 107 and the second lid member 106 has a second lid opening 108 aligned with the first lid opening 107 to receive a hollow shaft 110 of a spring tension adjusting screw 111. The hollow shaft 110 of the spring tension adjusting screw 111 is configured substantially complementary to a polygonal coupling end 109 of the slotted shaft member 97 so that rotation of the spring tension adjusting screw 111 is converted into rotation of the slotted shaft member 97. A conical pressure spring (not shown) may be provided on the polygonal coupling end 109 of the slotted shaft member 97 so that a pressure on spring tension adjusting screw 111 becomes resilient and urges the conical pressure spring to return to the least tensioned condition. The conical shape of the pressure spring allows this pressure spring to be made flat without taking up axial space so that this conical pressure spring does not limit the travel of the spring tension adjusting screw 111**.

The bottom opening 99 of the bottom 98 of the tubular housing 93 has annularly spaced apart first locking webs 112 to engage annularly spaced apart second locking webs 113 on a lock plate 114 on the slotted shaft 97 opposite the polygonal coupling end 109. When the spring tension adjusting screw 111 is depressed the lock plate 114 is displaced axially and the first locking webs 112 and second locking webs 113 disengage thereby allowing rotation of the slotted shaft 97 to tension the spring **38*a* to the desired extent, which can be both loosing and tensioning of the spring 38*a*. Once the desired tension is reached by rotating the spring tension adjusting screw 111 the desired number of rotations the engagement between the first locking web 112 and the second locking web 113 is re-establish simply by releasing the pressure on the spring tension adjusting screw 111 so that the pressure spring re-assumes its un-tensioned condition. The first locking web 112 and the second locking web 113** may be complementary male and female protrusions and indents that tend to find into fittingly engagement with each other once the pressure spring is relieved.

The retraction and extension mechanism 92 is easy to operate, and simply by providing boxers with boxing devices with differently tensioned retraction and extension mechanism 92 a strong boxer using a highly tensioned retraction and extension mechanism 92 in a boxing device can box against a weaker boxer using a less tensioned retraction and extension mechanism 92 in a boxing device. Both boxers can drive their respective differently tensioned boxing devices forward to similar extent although they posses different physical ability to drive the buffer forward by punching. So it does not matter that the force the different boxers are able to put into the punch to create the propulsive force needed to drive the buffer forward is different. Both boxers have same benefits and fun of the match when using the boxing device of the present invention. A highly tensioned spring **38*a* has more windings on the slotted shaft than a less tensioned spring 38*a***.

Figure 22:
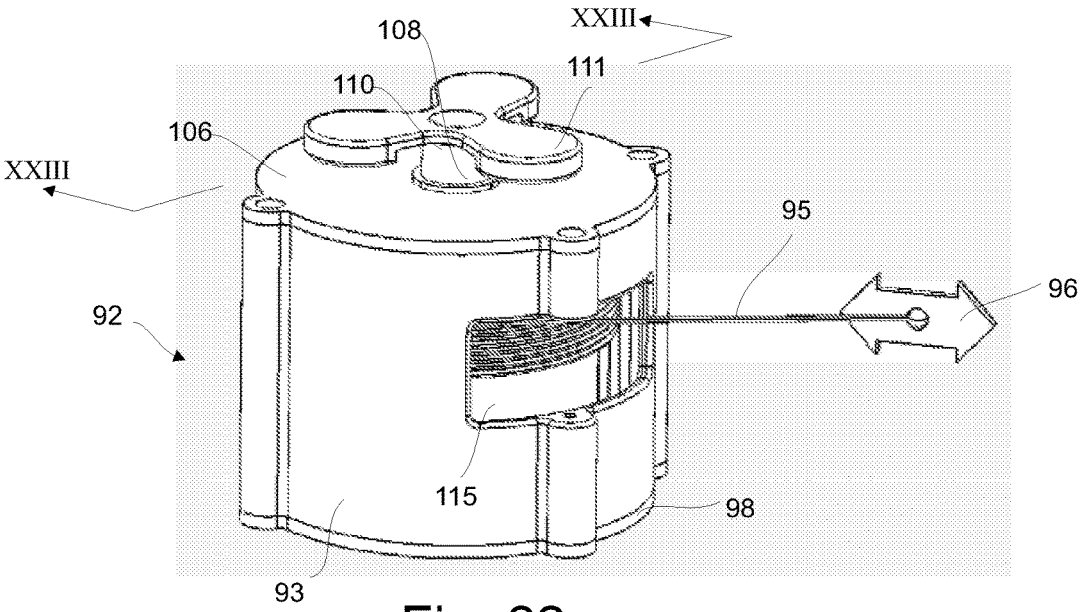
FIG. 22 shows the same in assembled state.

The tubular housing has an exit opening 115 for passage of the retraction string 95, as also seen in FIG. 22 of the retraction and extension mechanism 92 in the assembled state.

Figure 23:
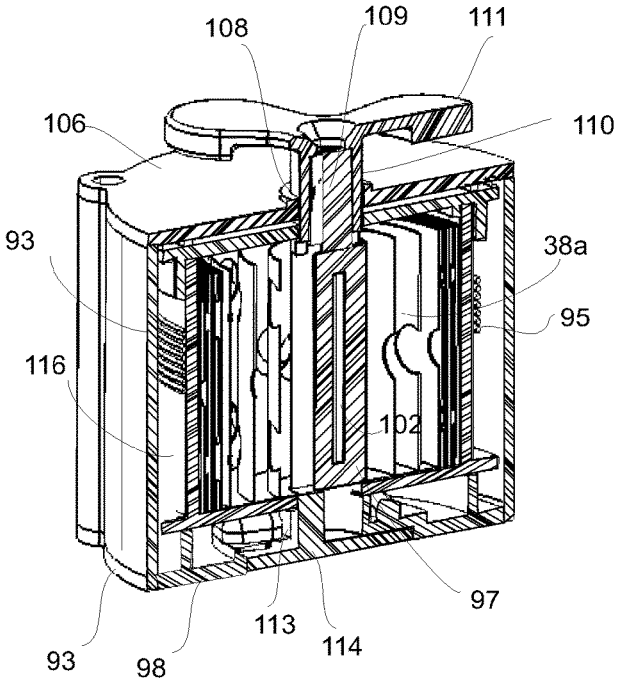
FIG. 23 is a sectional view taken along line XXIII-XXIII in FIG. 22.
Figure 25:
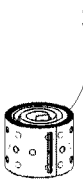
FIG. 25 shows the same in coiled condition.

In the sectional view of FIG. 23 taken along line XXIII-XXIII of FIG. 22, the mutual arrangement of the components of the retraction and extension mechanism 92 has been shown to illustrate the gap 116 between the tubular housing and the hollow spool that provides the space for the windings of the retraction string 95. The spring **38*a* is, as described above, coiled about the slotted shaft member 97**.

Figure 24:
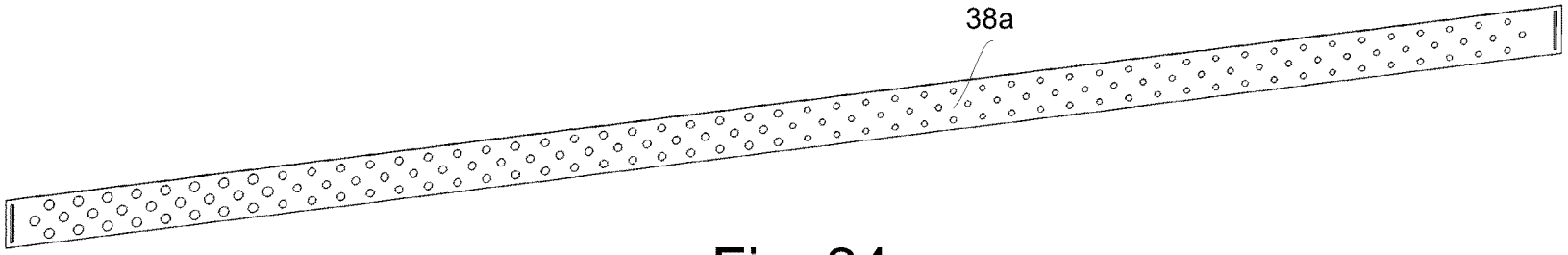
FIG. 24 shows a first embodiment of a stretched out spring for the spring mechanism of the retraction and extension mechanism.
Figure 26:
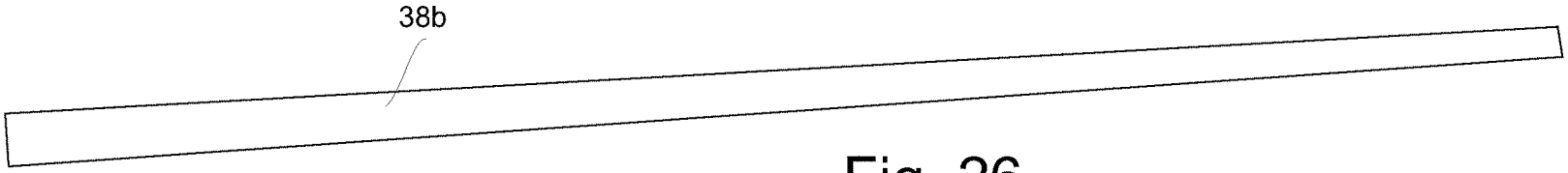
FIG. 26 shows a second embodiment of a stretched out spring for the spring mechanism of the retraction and extension mechanism.

As seen better in FIG. 24 the first embodiment of a spring **38*a* for the spring mechanism of the retraction and extension mechanism 92 described above has a plurality of holes 117 the size of which decreases from the inner end 103 attached to the slotted shaft member 97 towards the opposite end 104. The provision of the holes 117 reduces goods at the inner end 103 compared to goods at the opposite end to improve the ability of the spring 38*a* to tension and un-tension, and thus to retract the retraction string 95 by rotating the spool. Similar property can be achieved by another embodiment of a spring 38*b* seen in FIG. 26. Goods are reduced by making a solid spring 38***b* tapered. Preferably the widest end is used as the inner end and the smallest end as the end attached to the spool.

As mentioned above and on the drawing shown, the boxing device has both a single and a triangular element assembly.

Within the scope of the invention the boxing device can however have other configurations of element assemblies, for example two single element assemblies placed on top of each other.

Within the scope of the invention the spring arrangement can also be of other kinds than a spiral spring, such as e.g. pieces of tension springs or elastics spread and connected along the element assembly of the boxing device.

Further, the buffer of the boxing device can within the scope of the invention be of any kind adapted to secure the boxers against being injured during a harmless boxing match. The buffer thus can be a ball of an elastic material such as rubber and be filled with air. At least one aperture in the wall of the ball could allow the air to escape and thereby the ball to make a sound when the opposite boxer has been hit.

Above is also mentioned and shown on the drawing that two boxers act in the harmless boxing match of the invention. Within the scope of the invention a single boxer can however alone act in the boxing match while fighting against an imaginary boxer and/or for enjoying the game and the healthy motion achieved by exercising the movements of the body, arms and hands in similar way of a conventional boxing match.

An important purpose of using the boxing device according to the present invention is not just healthiness. Also use in a game performed as a boxing match is an exciting and amusing experience for just one boxer that box against a stationary target or a game between two or more boxers.

What is claimed is:

1. A boxing device for performing a harmless boxing match, the boxing device comprising a base, a buffer configured to hit a target without injuring said target, and an extensible joint that connects the base and the buffer to move said buffer between a retracted position and one or more extended positions, wherein the extensible joint is an element assembly of at least two extension elements, wherein the extensible joint is structured to provide an overall rigidity to the extensible joint in the one or more extended positions along a longitudinal axis of said extensible joint, and the extensible joint is configured to move the buffer into the one or more extended positions by virtue of a propulsive force transferred to the extensible joint by a punch done by a hand of a boxer holding the boxing device, and auto-retract after the punch has been performed.

2. The boxing device according to claim 1, wherein the extensible joint is made of one or more rigid materials.

3. The boxing device according to claim 2, wherein the boxing device is configured so that propulsion of the buffer is done exclusively by moving an arm and/or the hand of the boxer.

4. The boxing device according to claim 1, wherein the extensible joint has a length that is shortest in the retracted position and extensible to longer lengths to achieve the one or more extended positions of the buffer of the boxing device.

5. The boxing device according to claim 1, wherein the element assembly of the at least two extension elements comprises at least one linearly, foldable and extensible, row of the at least two extension elements.

6. The boxing device according to claim 1, wherein the boxing device has a handle mounted to or formed in the base.

7. The boxing device according to claim 1, wherein the buffer is configured to yield to absorb an impact resulting from contact with the target.

8. The boxing device according to claim 1, wherein the target is another boxer or the target is a dummy or a picture.

9. The boxing device according to claim 1, wherein the boxing device has electronic gaming means to register and elicit a signal in response to contact with the target.

10. The boxing device according to claim 9, wherein the signal is stored in a computer program configured to make statistics of hits and/or mis-hits.

11. The boxing device according to claim 1, wherein the boxing device is configured to move the buffer without a need for opening and closing fingers of the hand of the boxer around a trigger.

12. A physical exercise tool, a boxing training device, a toy or a game comprising the boxing device of claim 1.

13. A boxing device for performing a harmless boxing match, the boxing device comprising a base, a buffer configured to hit a target without injuring said target, and an extensible joint that connects the base and the buffer to move said buffer between a retracted position and one or more extended positions, wherein the extensible joint is an element assembly of at least two telescopically connected extension elements, the extensible joint is configured to move the buffer into the one or more extended positions by virtue of a propulsive force transferred to the extensible joint by a punch done by a hand of a boxer holding the boxing device, and auto-retract after the punch has been performed, wherein the at least two telescopically connected extension elements are tube sections that form a telescopic tube.

14. The boxing device according to claim 13, wherein at least one friction-reducing means is interposed between circumferential walls of the tube sections, wherein the friction-reducing means is a linear slide bearing comprised of gliding elements in at least one bearing element provided on at least one adjacent wall of two consecutive tube sections along a longitudinal axis of the extensible joint, wherein the extensible joint is a telescopically extensible joint, and wherein the gliding elements are a plurality of balls rotatably confined in an axially extending guideway.

15. A method for performing a harmless boxing match between a boxer and a target, wherein the method comprises the steps performed by the boxer of: (a) providing at least one boxing device comprising a base, a buffer intended to hit the target in a harmless way, and an extensible joint that connects the base and the buffer, wherein the extensible joint has a length that is shortest in a retracted starting position of the harmless boxing match and extensible to longer lengths to achieve other positions of the buffer of the at least one boxing device, (b) taking hold at the base of the at least one boxing device by a hand of an arm of the boxer, (c) taking a position at a distance from the target selected to allow the boxer to reach the target with the buffer when the at least one boxing device is in another position than the retracted starting position but not reaching the target with the hands of the boxer, (d) moving and/or bending the arm of the boxer holding the at least one boxing device at least partly backwards while the extensible joint is in the retracted starting position, and (e) pushing the at least one boxing device against the target by moving the arm of the boxer forward, in a direction of the target and so fast, that the extensible joint extends from the retracted starting position to a temporary other position, including an end position or a position in which the target has been hit by the buffer; wherein the target is a dummy or a picture, or wherein the target is another boxer placed within the distance from the boxer that allows the boxer and said another boxer to hit each other in extended positions of the extensible joint and not with their hands or with the buffer when the extensible joint is in the retracted starting position.

16. The method according to claim 15, wherein the method includes that the boxer and said another boxer each activate a computer program that registers data of hits and/or mis-hits of the harmless boxing match.

17. The method according to claim 15, wherein the boxer and said another boxer use a common computer program or a separate computer program and the boxer and said another boxer are remote from each other without sight of each other to box against each other via the common computer program or the separate computer program, wherein the common computer program or the separate computer program is started at a beginning at the harmless boxing match and terminated at an end of the harmless boxing match, and wherein synchronization of an activation of the common computer program or the separate computer program is performed via the Internet.

* * * * *